US010667583B2

(12) United States Patent
Moran

(10) Patent No.: US 10,667,583 B2
(45) **Date of Patent: *Jun. 2, 2020**

(54) LOCKING MECHANISM WITH ONE AND TWO STAGE LOCKING VERIFICATION

(71) Applicant: CONTROL DYNAMICS, INC., Everett, WA (US)

(72) Inventor: Eric M. Moran, Camano Island, WA (US)

(73) Assignee: Control Dynamics, Inc., Everett, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/211,758

(22) Filed: Dec. 6, 2018

(65) Prior Publication Data

US 2019/0110558 A1 Apr. 18, 2019

Related U.S. Application Data

(63) Continuation of application No. 16/103,759, filed on Aug. 14, 2018, now Pat. No. 10,231,518, which is a (Continued)

(51) Int. Cl.
*A44B 11/25* (2006.01)
*G08B 21/18* (2006.01)

(52) U.S. Cl.
CPC ..... *A44B 11/2569* (2013.01); *A44B 11/2519* (2013.01); *G08B 21/18* (2013.01)

(58) Field of Classification Search
CPC ..... A44B 11/2519; A44B 11/2542; A44B 11/2569; A44B 11/2573; G08B 21/18; (Continued)

(56) References Cited

U.S. PATENT DOCUMENTS 2,903,774 A 9/1959 Harley
3,090,092 A 5/1963 Szemplak et al.
(Continued)

OTHER PUBLICATIONS

DB Industries, Inc., DBI SALA Manual, "DBI SALA Exofit," pp. 1-32, see p. 20.

(Continued)

*Primary Examiner* — Steven Lim
*Assistant Examiner* — Mancil Littlejohn, Jr.
(74) *Attorney, Agent, or Firm* — FisherBroyles LLP; Kevin D. Jablonski

(57) ABSTRACT

A control docking station system for controlling locking engagement between a first female member and a male member that together form a locking mechanism. The first female member is connected to a safety device. The male member can be locked to and released from the first female member. The system includes a controller configured to sense an unsafe interlock signal. A second female member is operably connected to the controller's housing. Each female member includes a receiver base and a pair of pivoting locking tabs that is engageable with a key-like projection on the male member. The male member may be unlocked from the first female member when the controller senses an interruption to the unsafe interlock signal or if the unsafe interlock signal is overridden. The male member may be docked in the second female member during safe circumstances and/or the safety device is unused.

20 Claims, 25 Drawing Sheets

Related U.S. Application Data continuation of application No. 15/198,390, filed on Jun. 30, 2016, now Pat. No. 10,085,520, which is a continuation-in-part of application No. 15/065,582, filed on Mar. 9, 2016, now Pat. No. 10,238,184.

(60) Provisional application No. 62/186,557, filed on Jun. 30, 2015.

(58) Field of Classification Search
CPC .... B60R 2022/4808; B60R 2022/4816; B60R 22/48
USPC ..... 340/686.4; 24/365, 637, 641; 324/300–322
See application file for complete search history.

(56) References Cited

U.S. PATENT DOCUMENTS 3,644,967 A 2/1972 Romanzi, Jr. et al.
5,033,171 A 7/1991 Kasai
5,144,725 A 8/1992 Krauss
5,383,257 A 1/1995 Krauss
5,548,879 A 8/1996 Wu
5,556,415 A 9/1996 McEwen et al.
6,265,983 B1 7/2001 Baillargeon
6,668,434 B2 12/2003 Casebolt et al.
6,965,231 B1 11/2005 Cinoglu et al.
7,077,372 B2 7/2006 Moran
7,114,225 B2 10/2006 Casebolt et al.
7,261,264 B2 8/2007 Moran
7,275,613 B2 * 10/2007 Park ..... B60R 22/321 180/270
7,375,517 B1 * 5/2008 Cinoglu ..... A61B 5/0555 324/300
7,726,706 B2 6/2010 Moran
7,902,960 B2 3/2011 Tsuchimochi et al.
8,240,012 B2 8/2012 Walega et al.
9,238,573 B2 1/2016 Luminet et al.
9,402,447 B2 * 8/2016 Hortnagl ..... A44B 11/2519
9,578,929 B2 * 2/2017 Hung ..... A44B 11/2511
2002/0145515 A1 10/2002 Snowbarger et al.
2002/0170783 A1 11/2002 Goode
2002/0184742 A1 12/2002 Casebolt et al.
2004/0227626 A1 * 11/2004 Almaraz ..... B60R 22/48 340/457.1
2006/0048350 A1 3/2006 Coulombe et al.
2006/0222287 A1 * 10/2006 Gulvin ..... G02B 6/3508 385/16
2009/0078501 A1 3/2009 Mordecai et al.
2009/0243892 A1 10/2009 Cheung
2010/0013622 A1 * 1/2010 Rumps ..... A44B 11/2565 340/457.1
2010/0026025 A1 2/2010 McKay
2010/0101060 A1 4/2010 Walega et al.
2010/0243373 A1 9/2010 Johnson et al.
2011/0162177 A1 7/2011 Von Der Ahe et al.
2011/0239413 A1 10/2011 Milbright
2012/0124790 A1 5/2012 Richards
2013/0199854 A1 8/2013 Bagnaro
2014/0067668 A1 3/2014 Bellamy et al.
2014/0251725 A1 9/2014 Schurian et al.
2014/0298630 A1 10/2014 Hortnagl
2015/0074958 A1 3/2015 Hung
2015/0089777 A1 4/2015 Hung
2017/0000219 A1 1/2017 Moran
2017/0335583 A1 11/2017 Moran

OTHER PUBLICATIONS

Guardian Fall Protection, Instruction Manual, "Velocity SRL," pp. 1-8.
International Searching Authority of WIPO; Int'l Search Report & Written Opinion dated Jul. 14, 2016; PCT/US2016/028985; pp. 1-10.
International Searching Authority of WIPO; Int'l Search Report & Written Opinion dated Jul. 27, 2018; PCT/US18/30703; pp. 1-9.
Supplemental European Search Report; dated Nov. 23, 2018; EP 16818381.2; pp. 1-8.

* cited by examiner

LOCKING MECHANISM WITH ONE AND TWO STAGE LOCKING VERIFICATION

PRIORITY CLAIM TO RELATED APPLICATIONS

The present application claims priority and benefit from U.S. patent application Ser. No. 16/103,759, filed Aug. 14, 2018 and titled, "CONTROL DOCKING STATION FOR ONE AND TWO-STAGE LOCKING VERIFICATION" which, in turn, claims priority from U.S. patent application Ser. No. 15/198,390, filed Jun. 30, 2016 and titled, "CONTROL DOCKING STATION FOR ONE AND TWO-STAGE LOCKING VERIFICATION" which, in turn, claim priority from U.S. patent application Ser. No. 15/065,582, filed Mar. 9, 2016 and titled, "LOCKING MECHANISM WITH ONE AND TWO-STAGE LOCKING VERIFICATION" which, in turn, claims priority and benefit from U.S. provisional patent application Ser. No. 62/186,557, filed on Jun. 30, 2015, and titled and titled, "LOCKING MECHANISM WITH ONE AND TWO-STAGE LOCKING VERIFICATION". The entire content of the parent application and the provisional application is herein expressly incorporated by reference.

TECHNICAL FIELD

The invention generally relates to control docking stations having a controller and one or more locking mechanisms where locking engagement is controlled by the controller under sensed conditions. Each locking mechanism includes a male member and a female member. The female member includes a receiver base and a pair of pivoting locking arms.

BACKGROUND OF THE INVENTION

A need exists for a controller that senses and controls locking engagement between a locking mechanism having a female member and a male member when a portion of the locking mechanism is attached to a device, particularly a safety device where locking engagement must be tightly controlled to avoid safety hazards. Such a control system is particularly useful in the determination of when a portion of a locking mechanism that is attached to a human worker may safely be detached and safely held, or "docked," until safety conditions allow for reengagement.

SUMMARY OF THE INVENTION

A control docking station for a locking mechanism system includes two or more female members and a male member to provide locking engagement between one of the female members and the male member under controlled circumstances. The system includes a controller configured to sense an unsafe interlock signal and to control locking engagement between the male member and a least a first of the female members when the unsafe interlock signal is not longer sensed. The controller includes a container having an exterior surface to which a second (or more) female member is operably connected.

Each female member includes a receiver base and a pair of pivoting locking tabs. Each locking tab has a first arm and a second arm connected by a joint that is rotatably connected to the receiver base about a pivot pin. The male member comprises an insert having a key-like projection having a leading edge that is configured to be in locking engagement with the locking tabs and receiver base.

The first female member is attached to a safety device. The male member also includes a portion that is engageable with a device, which is operably connected to the safety device through the first female member.

The system may also include magnetic actuators and corresponding electronic switches that are controlled by the controller when an unsafe interlock signal is interrupted. At that time, the insert may be safely removed from the first female members and inserted within the second (or more) female members operably connected to the controller container.

The system may optionally include visible indication when an unsafe interlock signal is sensed, where the male insert may not be separated from the safety device. The invention may optionally also include visible indication when the unsafe interlock signal is interrupted. Then it is safe to separate the male insert from the first female member and dock the male insert into the second female member operably connected to the controller.

The system may further include an optional explosion-proof controller container for class I explosion-proof applications.

The invention also includes a method of verifying when a locking mechanism may be safely released from a safety device. The method provides two or more female members and a male member wherein the male member is able to be joined in locking engagement with either female member. A first female member is operably connected to a safety device and a second (or more) female member is operably connected to the exterior surface of the controller container.

Similar to the system above, each female member includes a receiver base having an upper portion and a pair of spaced apart chocks, and a pair of locking tabs. Each locking tab has a first arm and a second arm connected by a joint that is rotatably connected to the receiver base about a pivot pin. The first and second arms are positioned relative to the receiver base relative to a corresponding chock. The receiver base of the female member is operably connected to the exterior surface of the controller container.

Also similar to the system above, the male member includes an insert having a key-like projection and a leading edge. A portion of the insert opposite from the leading edge is configured to engage a device.

The method has the controller sensing the unsafe interlock signal. When the signal is interrupted, the male member insert may be safely removed from the first female member operably connected to the safety device. The insert then may be safely docked into the second female member positioned on the exterior of the controller container.

The system and method may be configured for multiple workers so that multiple locking mechanisms can be monitored at the same time. Once the unsafe interlock signal is interrupted for a locking mechanism at a safety device, the male member of the locking mechanism may be safely detached and docked into a female member operably connected to the controller.

Both the system and method may include a feature where the controller may be configured to provide visible indication for unsafe and safe conditions.

These and other advantages will become more apparent upon review of the Drawings, the Detailed Description, and the Claims.

BRIEF DESCRIPTION OF THE DRAWINGS

Like reference numerals are used to designate like parts throughout the several view of the drawings, wherein.

DETAILED DESCRIPTION OF THE INVENTION

Figure 1:
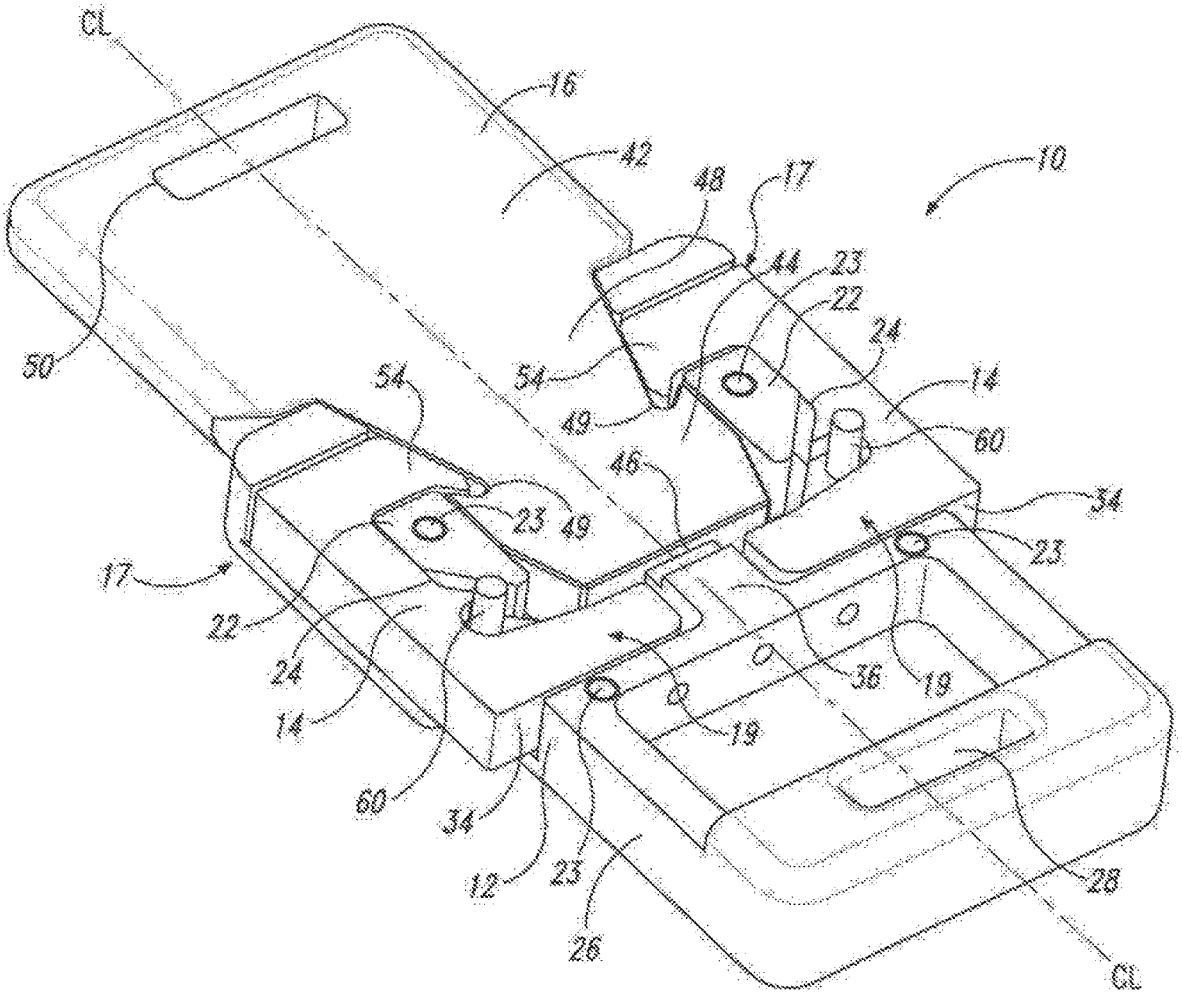
FIG. 1 is a front perspective view of an assembled locking mechanism of the first embodiment disclosing a receiver base, a pair of pivotable locking tabs about respective cylindrical posts, and an insert (illustrated without a cover)

Referring to FIGS. 1-11 and 16, locking mechanism 10 brings two devices together and maintains the connection until such time the connection is intentionally broken. Locking mechanism 10 includes a receiver base 12, a pair of pivotable locking tabs 14, and an insert 16 of which a portion is received within a cavity 18 of receiver base 12 and held in place by locking tabs 14. An optional cover 20 (FIGS. 6 and 10) may cover the majority of receiver base 12 and the majority of locking tabs 14 through fasteners 21 received into apertures 23 (such as those illustrated) or other commonly known fastener means.

Receiver base 12 includes two spaced-apart and outwardly-projecting chocks 22 that conform to the shape of an interior surface 24 of locking tabs 14 and further define the boundaries of the cavity 18 in which a portion of insert 16 is received. Receiver base 12 also includes a lower section 26 that is configured to engage a first device. According to one embodiment of the invention, lower section 26 contains an opening 28. The opening may be an elongated slot (as illustrated in FIGS. 1-3 and 5) to accommodate a safety strap 30 (see FIG. 2 for example) that is operatively connected to a first device, such as a safety harness for example. Opening 28 may be aligned below cavity 18 relative to centerline CL of receiver base 12.

Receiver base 12 may also include a generally central ledge 32 to which bottom portions 34 of the locking tabs rest against when in the locked position. Receiver base 12 may also include an optional central abutment member 36 to which a portion of insert 16 abuts when the insert is fully engaged and in the locked position relative to the receiver base and engaged by the locking tabs (as illustrated in FIG. 1).

Figure 7:
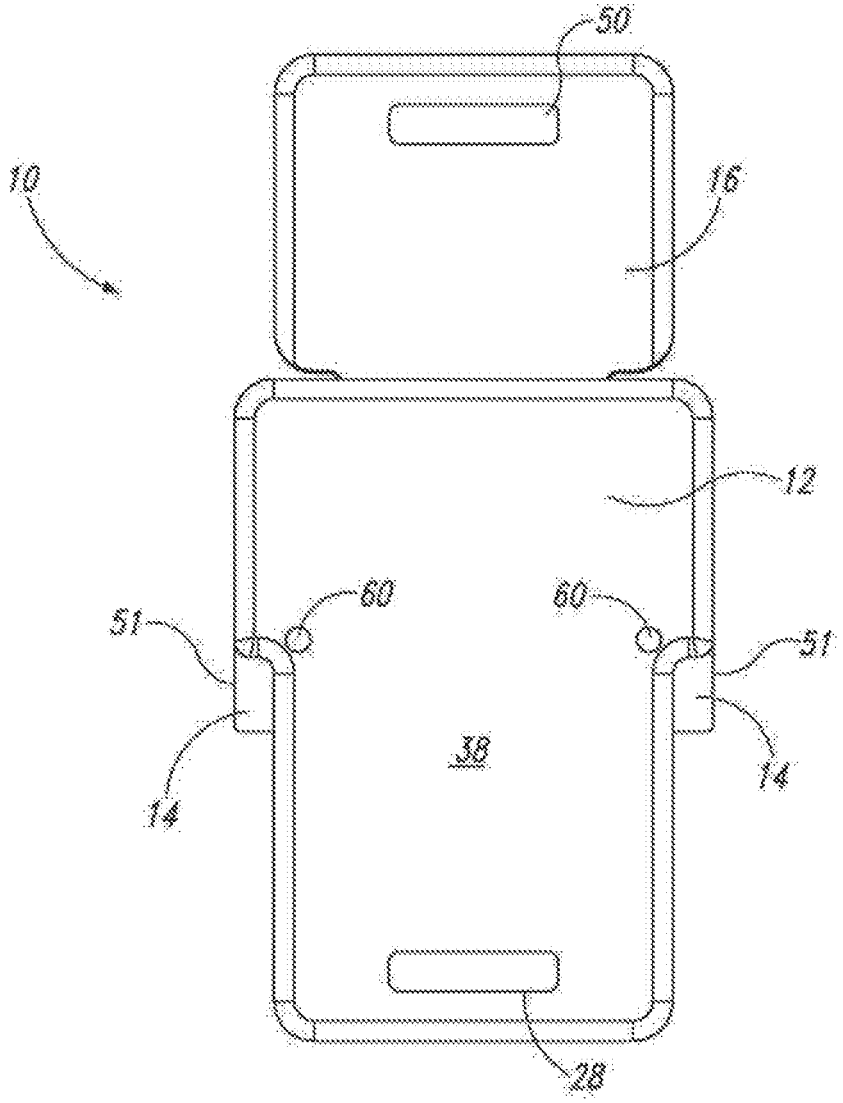
FIG. 7 is a back view of FIG. 1.
Figure 8:
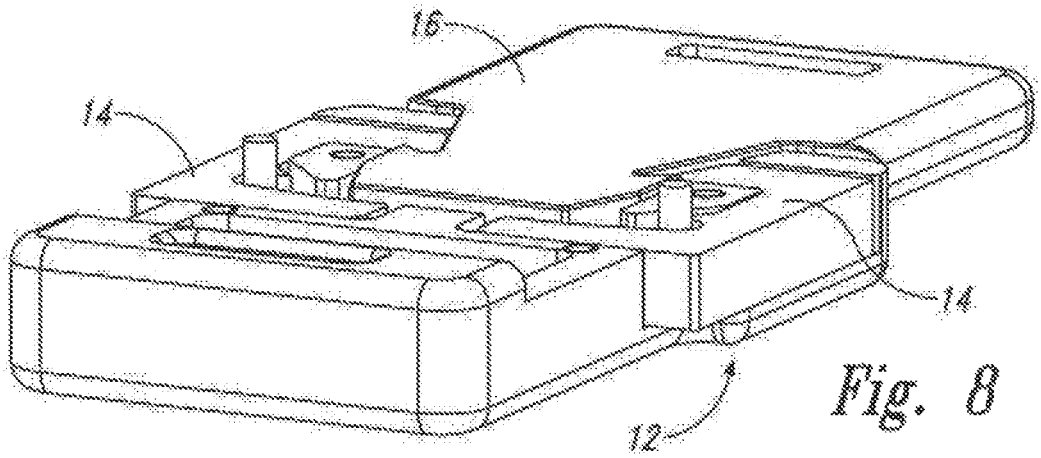
FIG. 8 is a rear perspective view of the assemble receiver base, locking tabs, and insert member.
Figure 9:
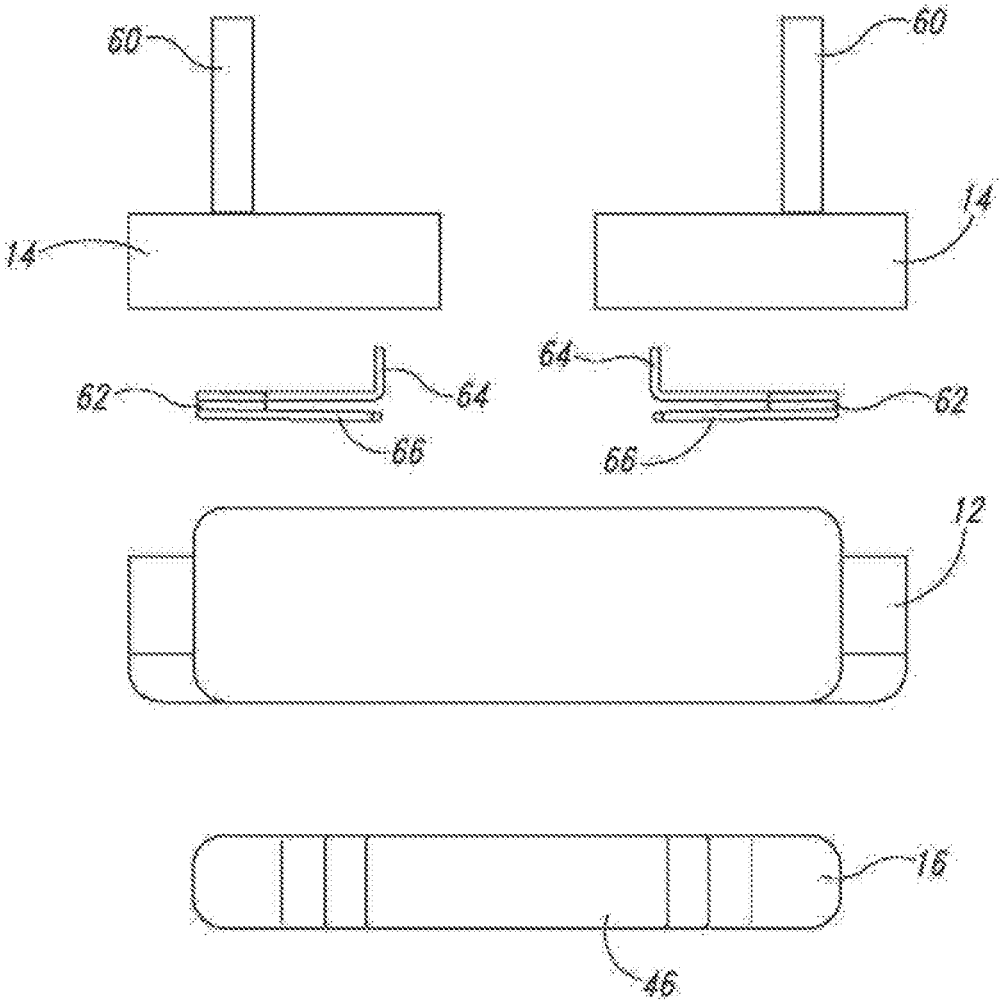
FIG. 9 is an exploded rear view of the receiver base, the insert, and the locking tabs and the cylindrical posts of FIG. 1.
Figure 11:
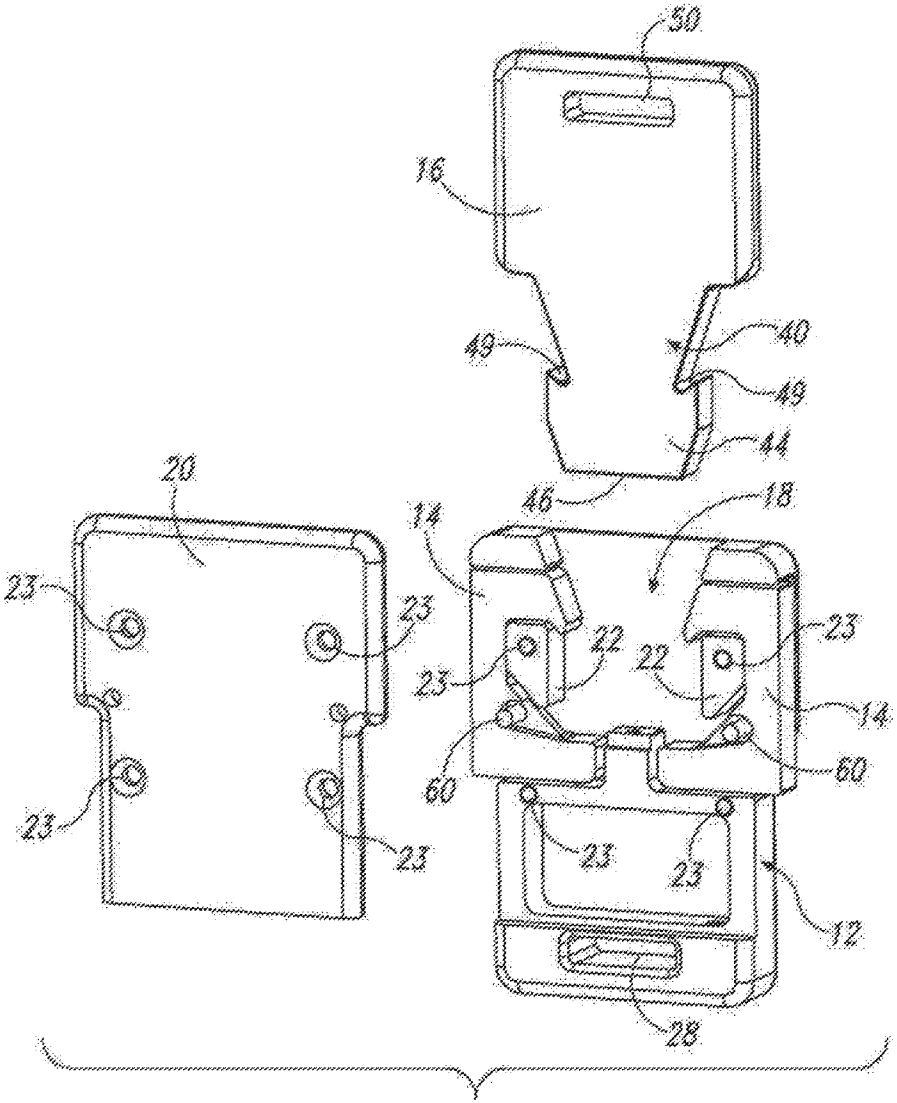
FIG. 11 is an exploded front perspective view of FIG. 10.
Figure 10:
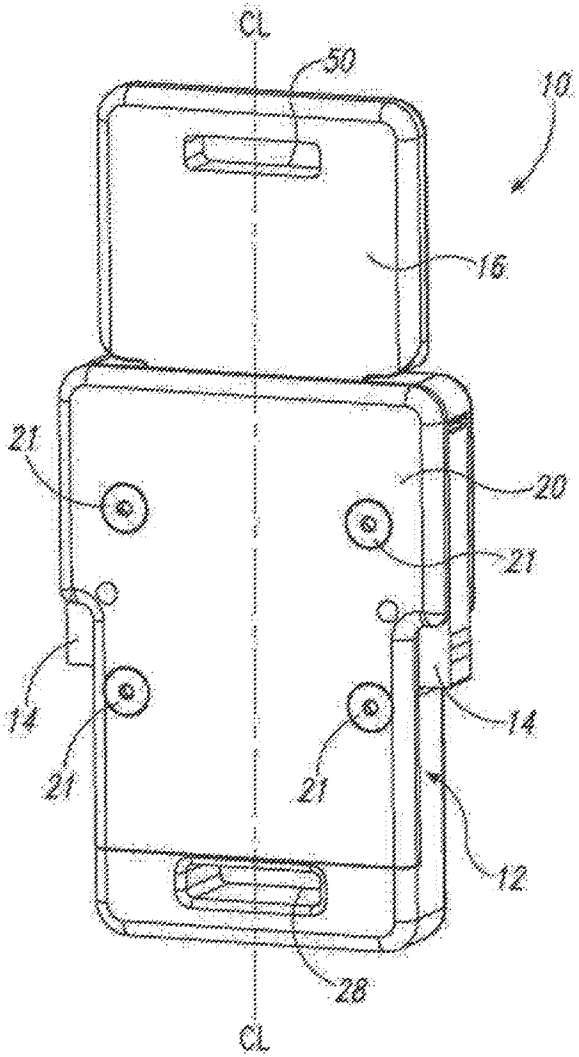
FIG. 10 is a front perspective view of the locking assembly with the cover placed over the receiver base and the locking tabs.
Figure 12:
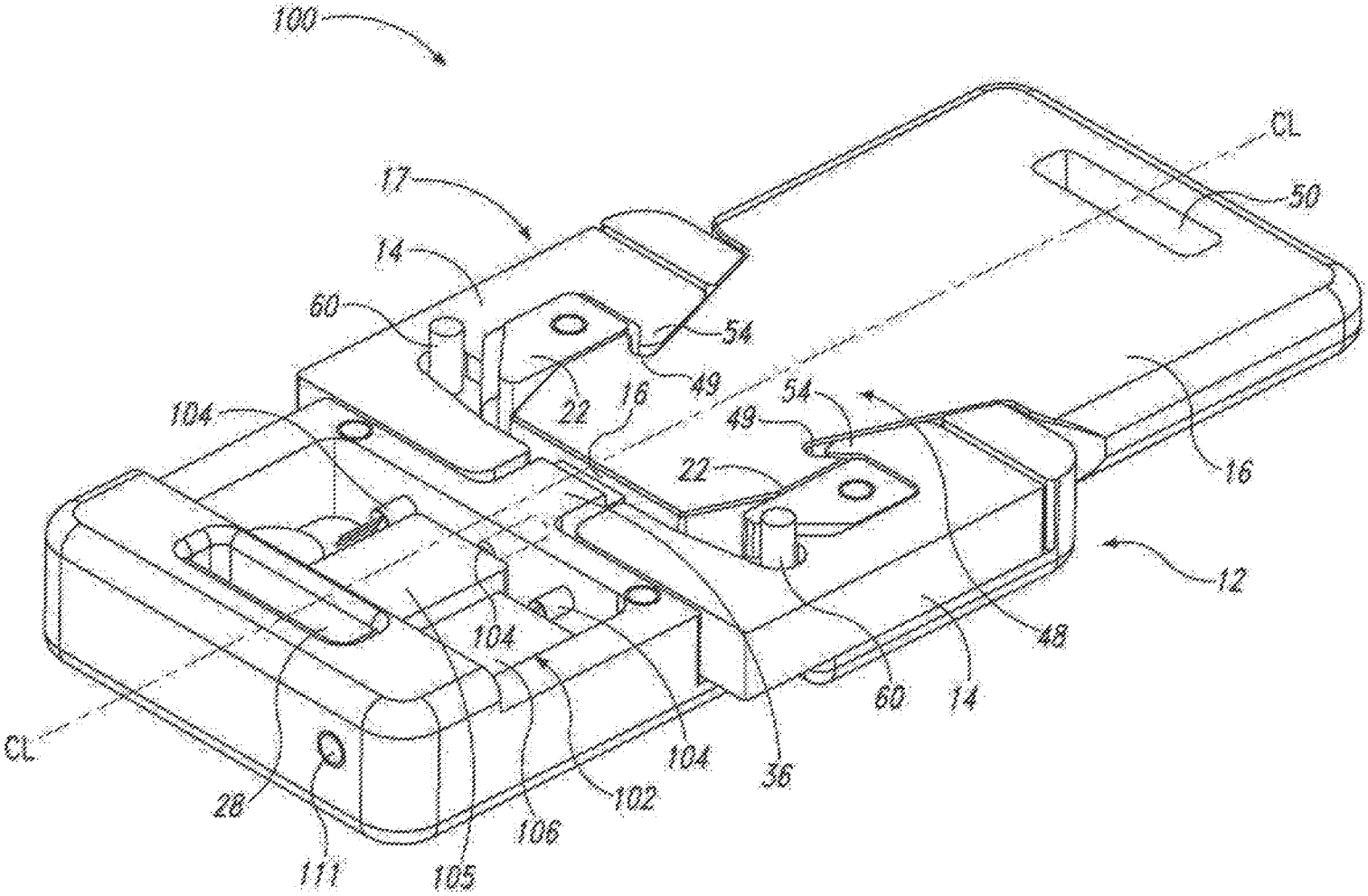
FIG. 12 is an assembled front perspective view of an alternate embodiment of the locking mechanism illustrating a receiver base, a pair of pivoting locking tabs, an insert, and an electronic bay with electronic components to provide a second stage of locking the locking mechanism (illustrated without a cover)

According to one aspect of the invention, receiver base 12 has a planar back surface 38 (see FIG. 7). In one form of the invention, cover 20 also includes a smooth planar exterior surface 40 (see FIG. 6). When the cover is assembled onto the receiver base, the two major surface of the assembled locking mechanism are smooth, planar, and parallel to each other (see for example FIGS. 10 and 16).

Insert 16 may be in the form of a solid planar slab 42 having a lower portion that includes an external key like projection 44 having a leading edge 46. Between projection 44 and an upper portion is a transition section 48 that forms a pocket 49 on each side of transition section 48. In one form of the invention, the transition and the key-like projection are received into cavity 18 of receiver base 12 along centerline CL when the insert is inserted into the receiver base in order to lock the locking mechanism. In the fully locked position, end surface 46 abuts the center ledge of the receiver base, or, alternatively, the central abutment member 36 as illustrated in FIG. 1. Opposite end surface 46 within slab 42 is an opening 50 that engages an object, such as a safety strap like safety strap 30. Opening 50 may be an elongated slot similar to opening 28 within receiver base 12. Here, the term key-like is meant to convey a non-planar surface having one or more indentations along an edge surface that is engageable with another surface.

Insert 16 is configured to be centerline-received into cavity 18 with key-like projection 44 and at least part of transition section 48 being able to be inserted within cavity 18 formed by receiver base 12, locking tabs 14, and chocks 22. In one form of the invention, leading edge 46 abuts central ledge 32 or central abutment 36. Opening 50 within insert 16 is aligned above opening 28 of the lower portion of receiver base 12.

Locking tab 14 may be of various shapes. The locking tabs each have a first arm 17 and a second arm 19 extending outwardly from a central point (the pivot point) where the first arm, second arm and pivot may form a general "L" shape. The first arm engages the lower portion of the insert, i.e., the "key like" projection and at least a portion of transition section 48. According to one embodiment of the invention, each locking tab has a top portion 52 that may be configured with a hook nose 54, a side portion 56, and bottom portion 34 (already introduced above). Each locking mechanism has an exterior surface 51 adjacent the pivot point. Top portion 52, side portion 56, and bottom portion 34 form an elongated "c-shaped" cavity 58 that corresponds to the shape of chock 22. In one form of the invention, the locking tabs outer surfaces (defined by the top portion, side portion, and bottom portion) have generally straight surfaces so that the exterior appears to be a partial rectangle. The second arm of each locking tab includes an upper surface 59 that is configured to contact leading edge 46 of insert 16 during unlocking. The second arm further includes a lower surface 61 that may rest on central ledge 32 of receiver base 12 when the locking mechanism is locked.

A cylindrical post 60 is inserted axially through bottom portion 34 and operatively connected to receiver base 12 (such as press fit connected into a tapped an threaded hole (see FIG. 3) or through other standard fastening means well known in the industry). In this way, bottom portion 34, side portion 56, and top portion 52 with nose 54 pivot about cylinder post 60 and are rotationally limited by its corresponding chock 22 and central ledge 32, as well as engagement with pocket 49 by nose 54 when insert projection 44 and at least a portion of the insert transition section 48 is inserted into cavity 18.

Figure 2:
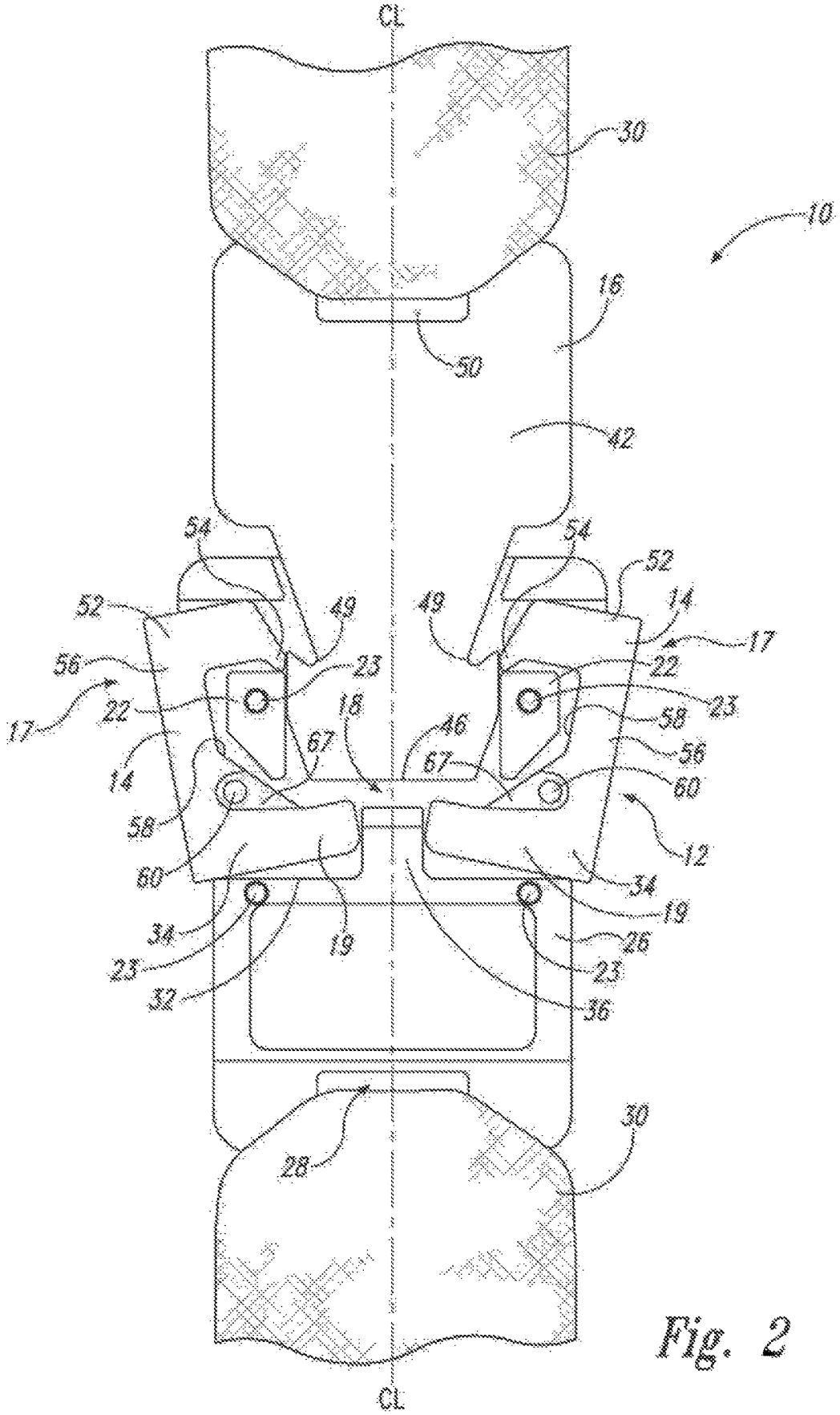
FIG. 2 is a front view of FIG. 1 with the pair of pivotable locking tabs pivoted to release the insert.
Figure 3:
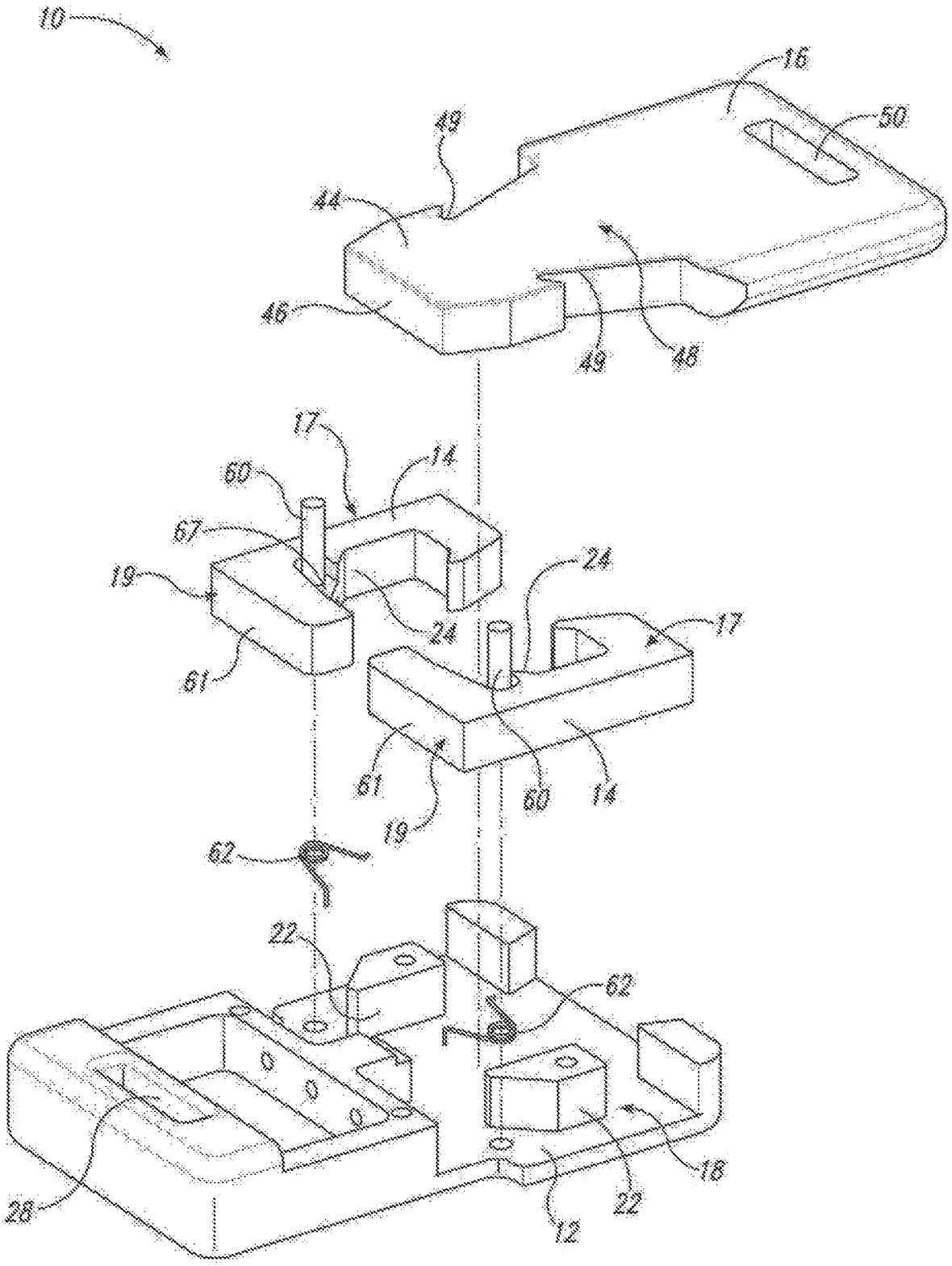
FIG. 3 is an exploded front perspective view like that of FIG. 1 except illustrated rotated 150 degrees and better illustrating a pair of pivot cylinders to which the locking tabs pivot about.
Figure 4:
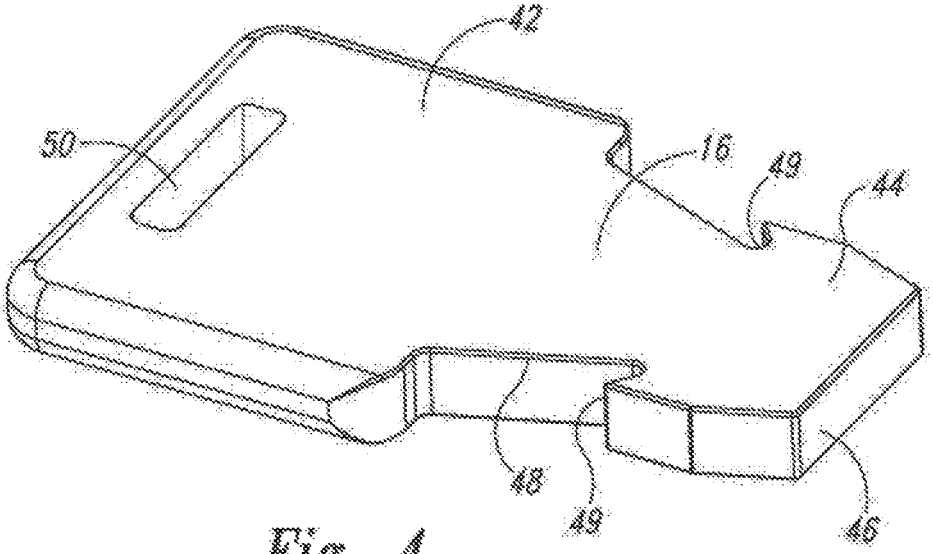
FIG. 4 is a front perspective view of the insert.
Figure 5:
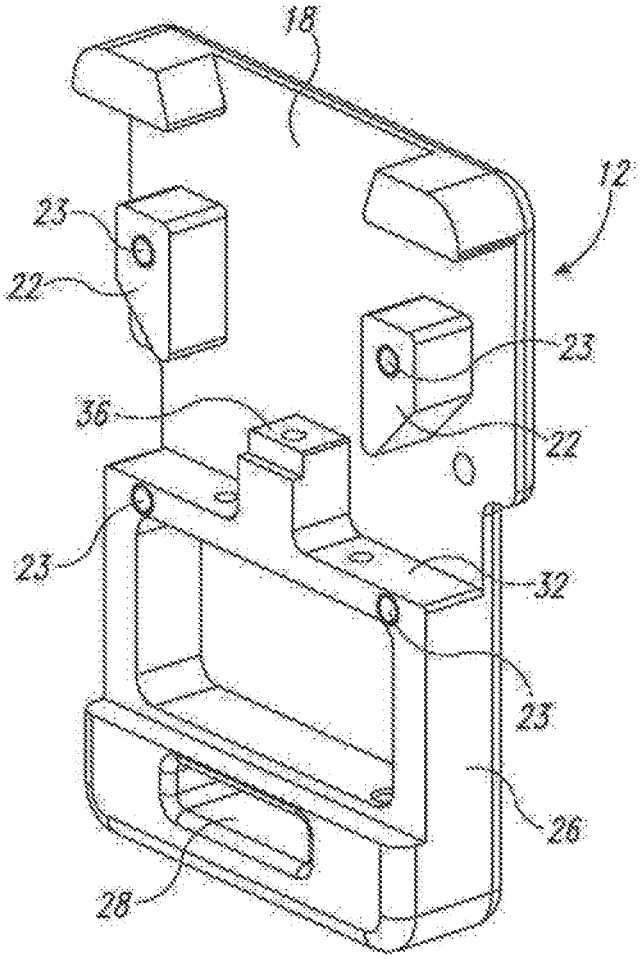
FIG. 5 is a front perspective view of the receiver base.
Figure 6:
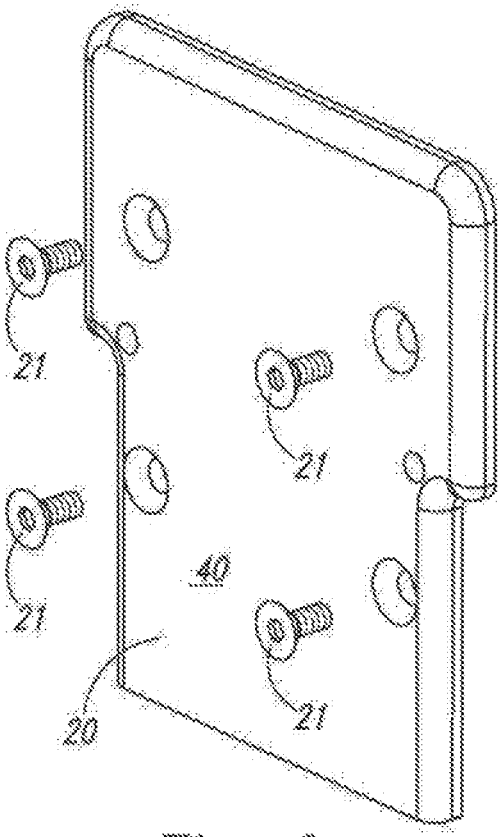
FIG. 6 is a front perspective view of a cover that covers over most of the receiver base when assembled.

A torsion spring 62 is positioned between the receiver base and each locking tab about cylindrical post 60. Each torsion spring included a first arm 64 extending from one end of the coiled spring that biases its respective locking tab an a second arm extending from the other end of the coiled spring that biases the adjacent chock 22. The torsion spring for the right side locking tab is the mirror image of the torsion spring for the left side locking tab. The torsion spring allows rotational movement with an indented general are on the back side of each locking tab about the pivot post (cylindrical post). The same general indented are 67, but on the front side of the locking tab is illustrated in FIGS. 2 and 3.

Figure 14:
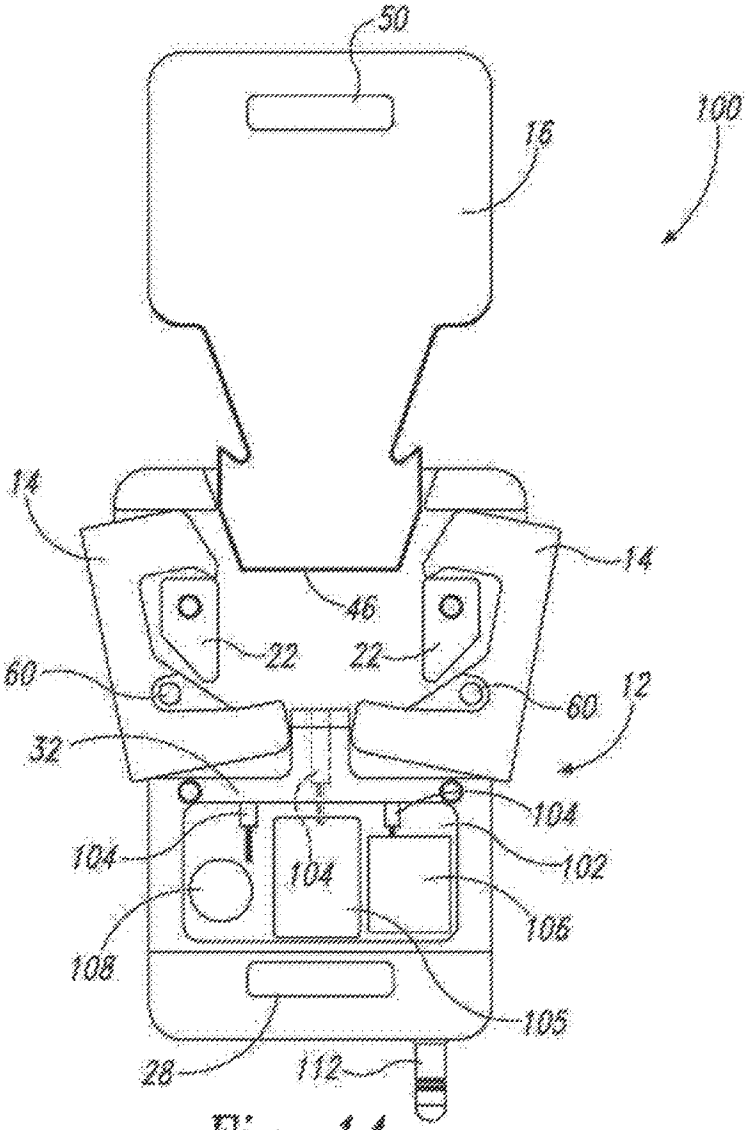
FIG. 14 is a front exploded view of the insert removed from the receiver base and the pivotable locking tabs pivoted to allow release of the insert.
Figure 13:
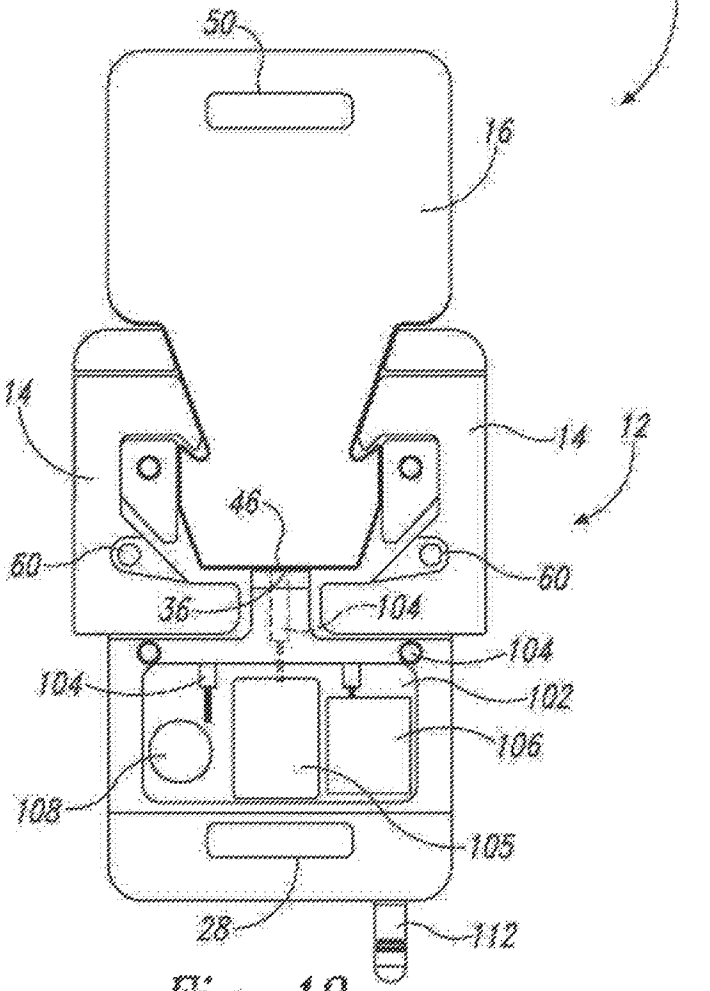
FIG. 13 is a front view of the locking mechanism of FIG. 12.
Figure 15:
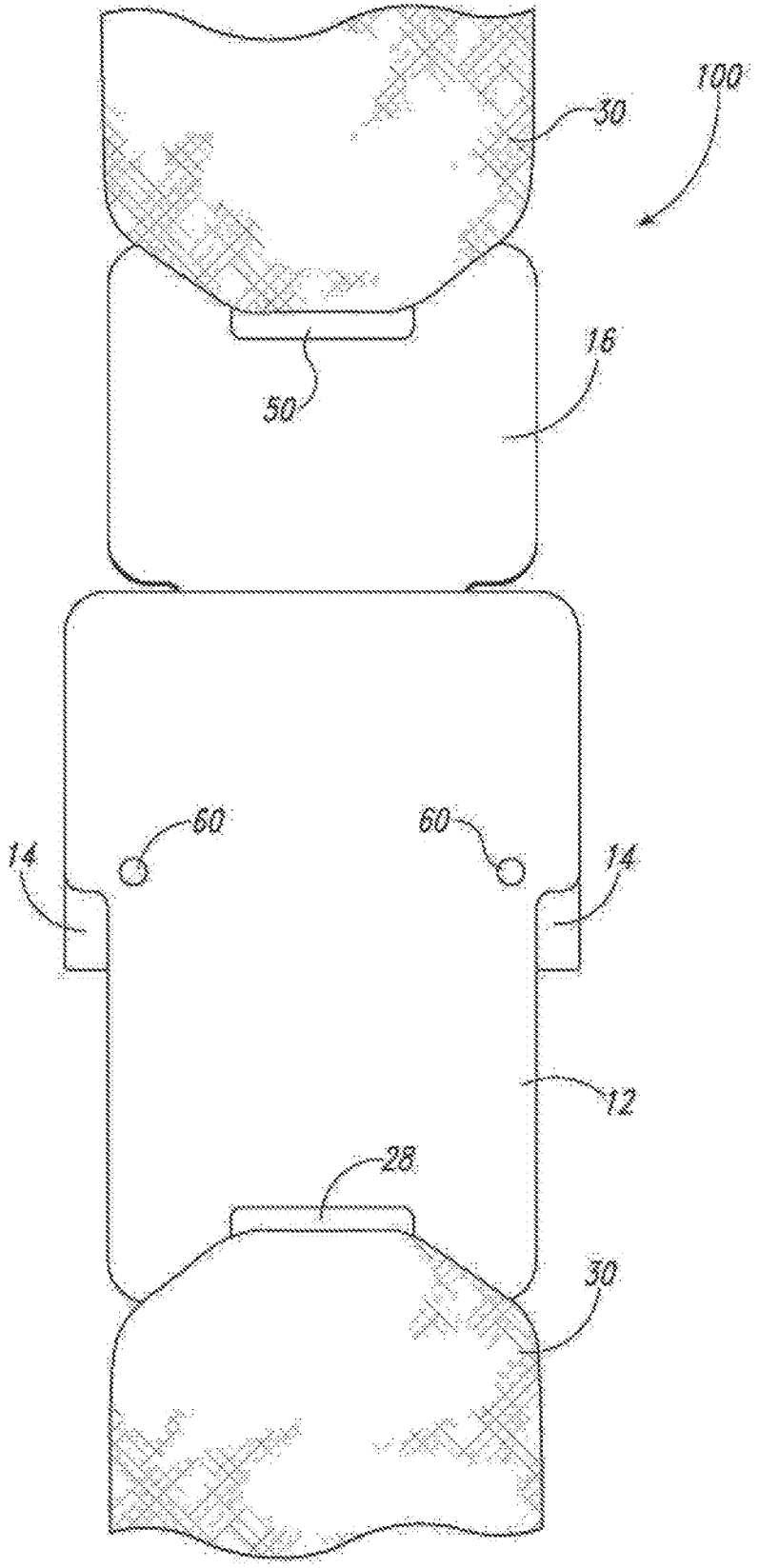
FIG. 15 is a rear view of FIG. 13.
Figure 16:
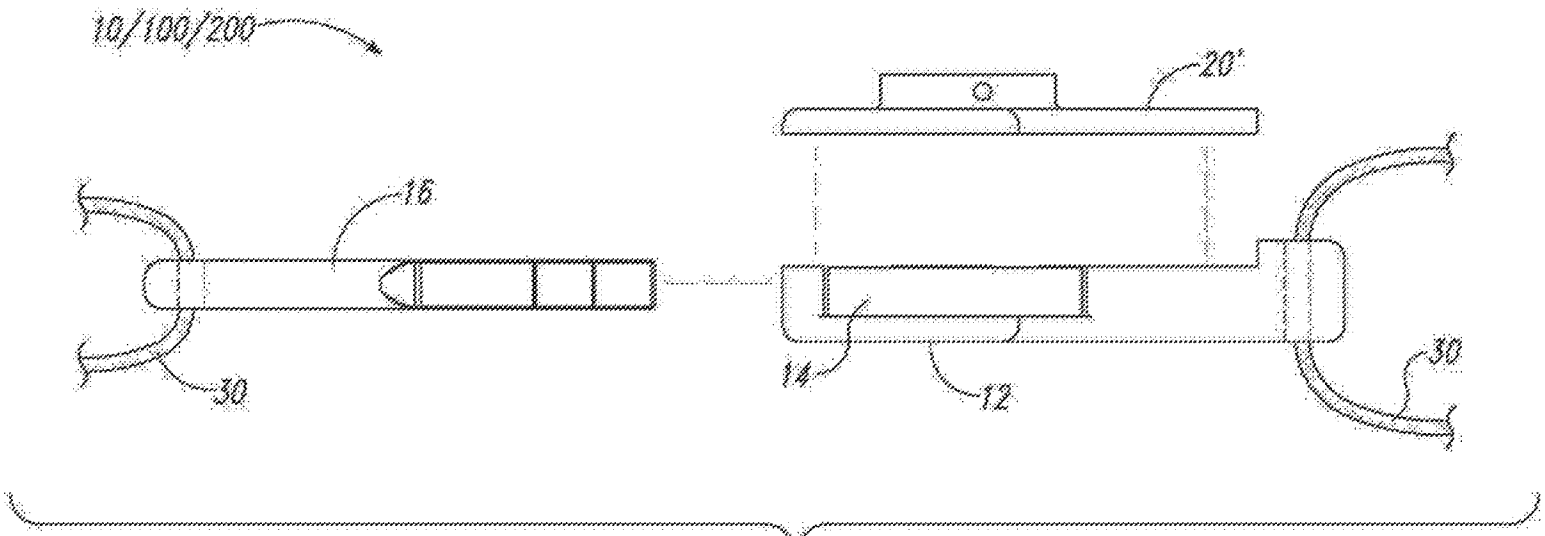
FIG. 16 is an exploded side view of the insert attached to a strap, the receiver base attached to a strap, and the cover.

When the locking mechanism is in the fully locked position (see FIG. 10), the exposed parts are mostly planar, which makes the locking mechanism less likely to get snagged or hooked during use. When the locking mechanism is unlocked, each first arm extends beyond outer edges of the receiver base. The extending first arms past the receiver base (see e.g., FIG. 14) are visible to a worker or third parties. Further, the outer edges of the insert, receiver base, and locking tabs may be chamfered to further reduce the potential of snags or hang ups. Cover 20 may be configured to leave the pivot corner of the locking tab, or at least exterior surface 51 of each locking tab 14, exposed for easy access.

Each top portion of the locking mechanism 52/54 engages one side of the insert projection 44 to retain and hold the insert projection within cavity 18 that is bordered by the receiver base, the chocks, and the first and second arms of each locking tab. To disconnect (unlock) the insert from the cavity, a user applies force on exterior surface 51 located near the pivot point on each locking tab in order to cause rotational movement of each second arm of the locking tab relative to its corresponding first arm of the locking tab. The second arm applies a force on the insert projection leading edge 46 and the first arm not longer engages the sides of insert projection 44. Exterior surface 51 may include knurling or other surface roughening for a worker to more easily engage the point of disconnection on locking tab.

Figure 25:
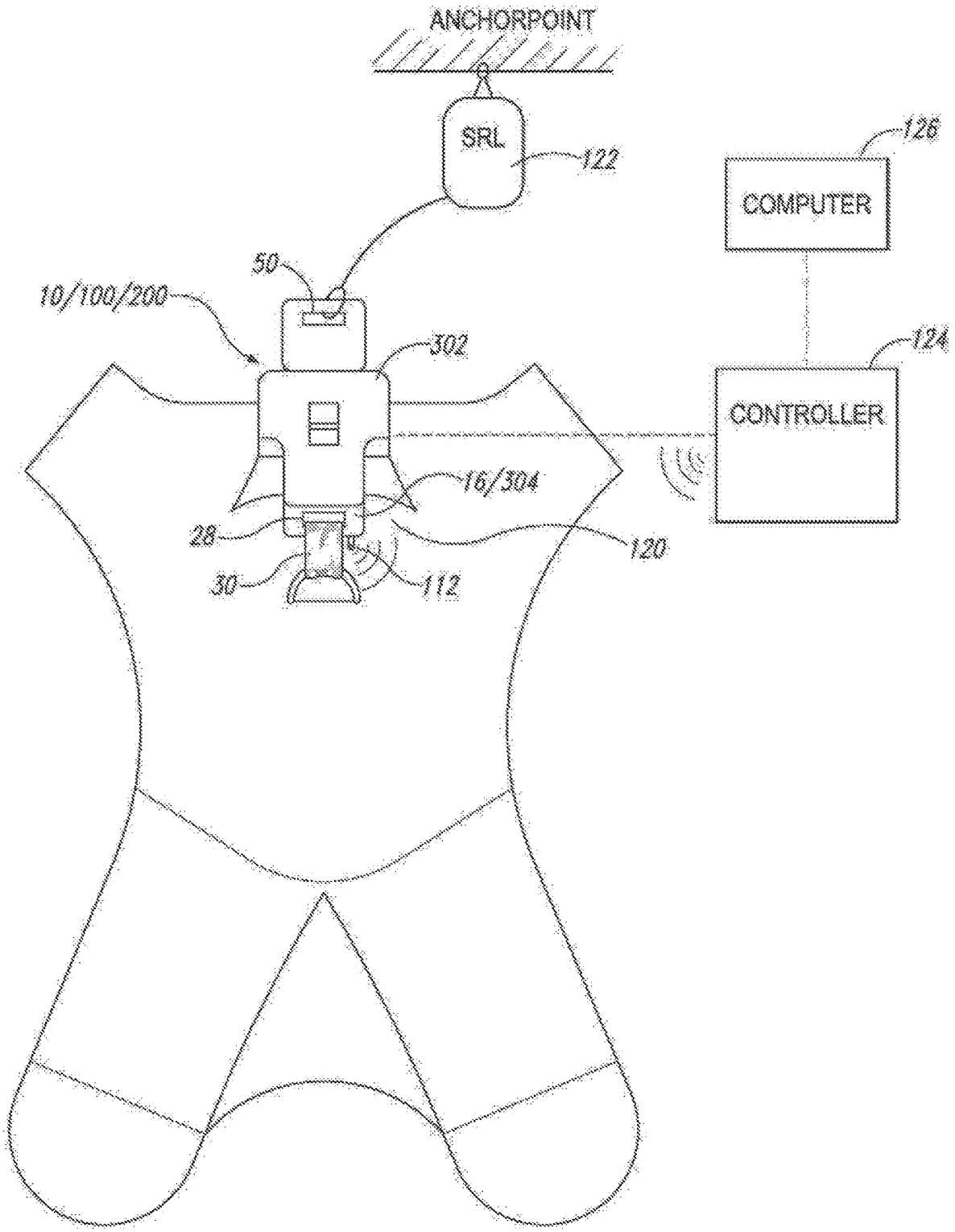
FIG. 25 is a schematic view of the locking mechanism (female member to a male member) connecting two devices together and electronically connected to a controller to signal to an optional computer when the connection is broken.

In use, as illustrated in FIG. 25, locking mechanism 10 may be used to connect tow devices together through attachment of the two devices to the insert and the receiver base, respectively. Locking mechanism 10 is particularly well suited to joining a first device, such as a safety harness 120 worn by a worker, that includes or is connected to safety straps, webbing, or cable, or some form of connector, where the safety strap, webbing, cable, or connector engages the receiver base, such as through opening 28. The insert, such as through insert opening 50, engages with a second device, such as a retractable lifeline 122, that itself includes or is connected to safety straps, webbing, cable, or connector. Other engagement means can be used such as those illustrate in FIGS. 17 and 18.

Referring now to FIGS. 12-15 and 19, a second embodiment locking mechanism 100 is directed to two-stage locking verification. Similar to locking mechanism 10 above with one-stage mechanical locking, second embodiment 100 includes the same one-stage mechanical locking features above. The same numeral designations are used to describe the second embodiment locking mechanism's mechanical locking functionality. That is that the second embodiment locking mechanism includes a receiver base 12, a pair of locking tabs 14, and an insert 16.

However, receiver base 12 also includes an electronic bay 102 that includes various electronic components to verify that insert 16 is fully engaged into cavity 18 and latched by locking tabs 14. The electronic components send a signal to an external device (such as a computer) that determines whether the locking mechanism can open and release the insert through the first locking means.

Figure 19:
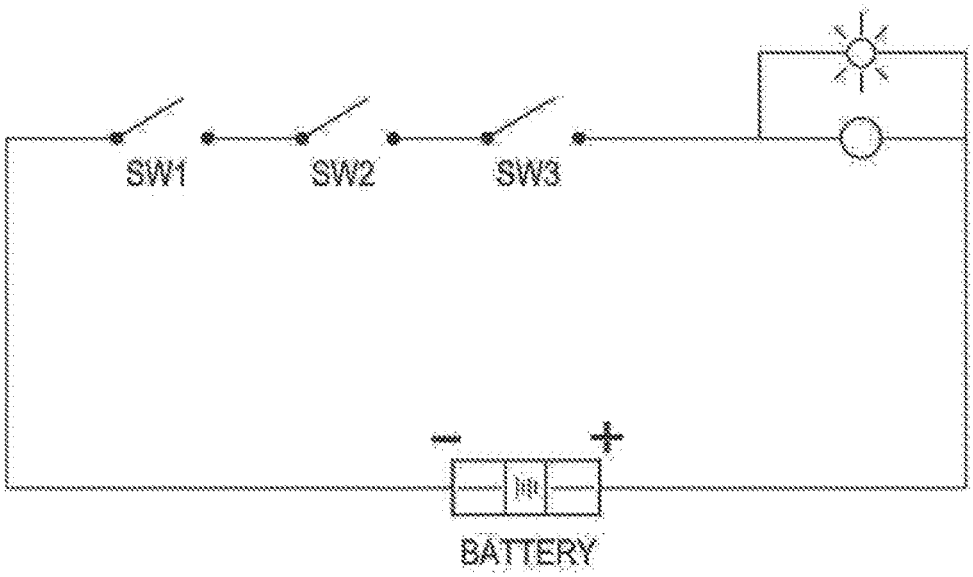
FIG. 19 is a schematic solid state wiring diagram of the electronic components of the harness side Bluetooth board.
Figure 20:
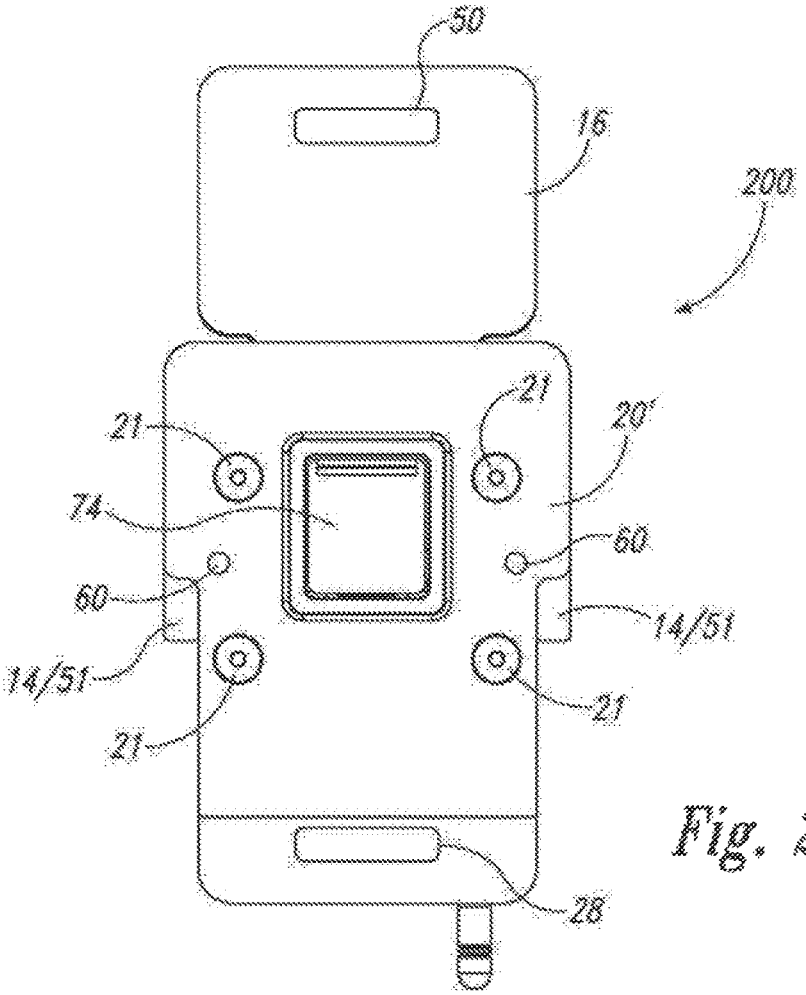
FIG. 20 is a front view of another alternate embodiment disclosing a secondary or tertiary locking element with an optional press button mechanism.
Figure 21:
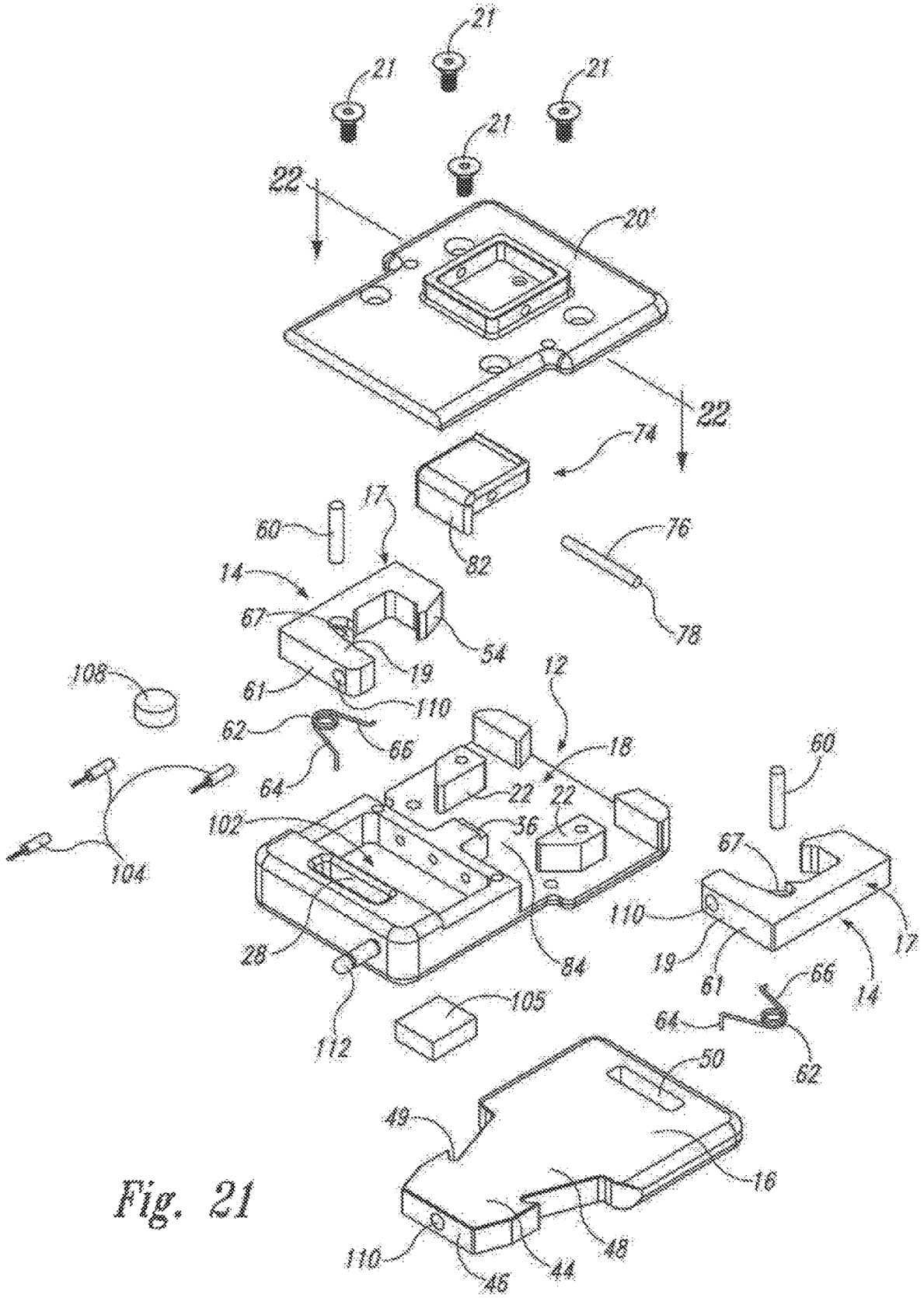
FIG. 21 is an exploded front view of the embodiment of FIG. 20.

Referring also to FIG. 19, electronic components may include embedded reed switches 104, a circuit board 105, a relay 106, embedded shielded proximity switches, a pressure switch that has mechanical engagement, an optical sensor, and optional indicator light (e.g., LED light) and a battery 108. These are positioned within the electronic bay 102. There are also magnetic actuators 110, preferably three, to match a corresponding reed switch 104. Magnetic actuators 110 are positioned outside the electronic bay (see for example FIG. 21).

The reed switches 104 may be a Hamlin 59010 Firecracker (3 mm dia., 9 mm long). They will be activated by the magnetic actuators placed in three locations opposite the reed switches. One location will be at the end of the insert, another under the left hand locking tab, and the remaining one under the right hand locking tab. All three switches will normally be in the open position until the magnetic actuator changes their state.

After all three switches are closed by the mechanical action of inserting the insert into the receiver base cavity (one-stage locking or stage one), then the electronic components will receive electrical energy from the battery. After the electronic components have communicated via various protocols, such as Bluetooth, near field communication, RFID, Zigbee, or other wireless communications means, that the mechanical (stage one) locking has taken place, a remote computer/processor processes the safe signal, that may be sent via a wireless antenna 112 (see e.g., FIG. 13), received with an aperture 111 within receiver base 12, and will close the dry contacts, such as on a machine interface board (not illustrated). The sensed signal will block electrical signals to an affected machine control function (stage two). Here, in the second stage, the locking mechanism 100, through mechanical closure, triggers a communication between the locking mechanism 100 to a machine (not illustrated) that may be attached to or a controller 124 (see e.g., FIG. 25) that may be interfaced with a machine or multiple machines or to a complete overall monitoring system.

The two-stage locking mechanism with verification capabilities (e.g., remote processor signaling) is particularly useful for dangerous applications where human life (or safety) is at rick or where sensitive expensive equipment is at risk. One application for the two-stage locking mechanism 100 is between a worker in a safety harness 120 and a retractable lifeline 122 where an employer (or construction boss) needs to ascertain with more certainty whether it is safe for a worker to detach from a lifeline. The connection or disconnection can be signaled to a controller 124, which can be forwarded to a computer device 126 that can be networked with an internal or external safety monitor command center (not illustrated). Further, the locking mechanism (10 or 100) allows a worker to remove him or herself from a lifeline without removing the worker's safety harness.

Figure 18:
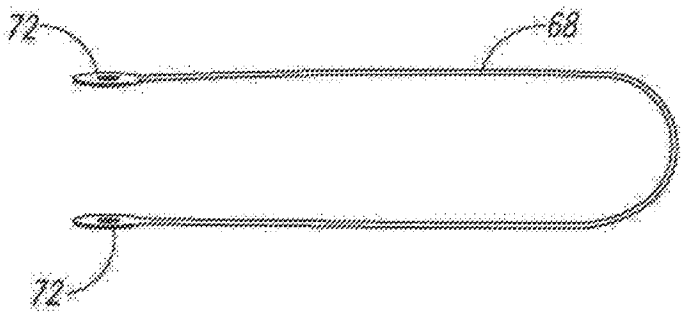
FIG. 18 is a schematic view of a cable that may be received by the alternate attachment, means disclosed in FIG. 17.
Figure 17:
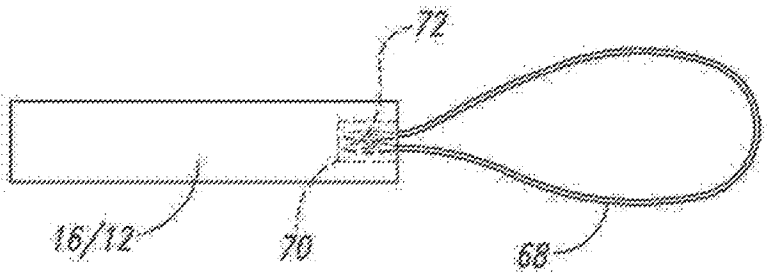
FIG. 17 is a schematic view of an alternate strap attachment means.

FIGS. 17 and 18 illustrate a different means for engaging a cable 68 or strap. Instead of a safety strap being threaded between opening 28 and 50 or the receiver base and insert, respectively, the cable or strap ends are captured within an opening 70 that opens through the outer edge of the receiver base and/or insert as illustrated in FIG. 17. Cable or strap 68 includes flexible expanding end portions 72 that can be inserted into opening 70 but cannot come out without cutting the cable/strap. Alternatively, cable ends can be epoxied or other permanent fastening means within opening 70.

FIGS. 20-24 disclose another alternate embodiment locking mechanism 200 with either secondary or tertiary locking verification means. Locking mechanism 200 can be used in connection with the one-stage locking verification means found in locking mechanism 10 or used with locking mechanism 100 (two-stage locking verification means), depending on the type of application that is desired. Locking mechanism 200 contains a receiver base 12, a pair of locking tabs 14, and an insert 16 all like those elements described in detail above. Cover 20' however is different from cover 20 in that it is adapted to accommodate a centrally positioned push button mechanism 74.

Push button mechanism 74 includes a centrally positioned rod 76 that extends past the confines of a mechanism housing 75 to form ends 78. The mechanism housing is operably connected to a spring 80 that is biased against the interior of the receiver base.

Figure 22:
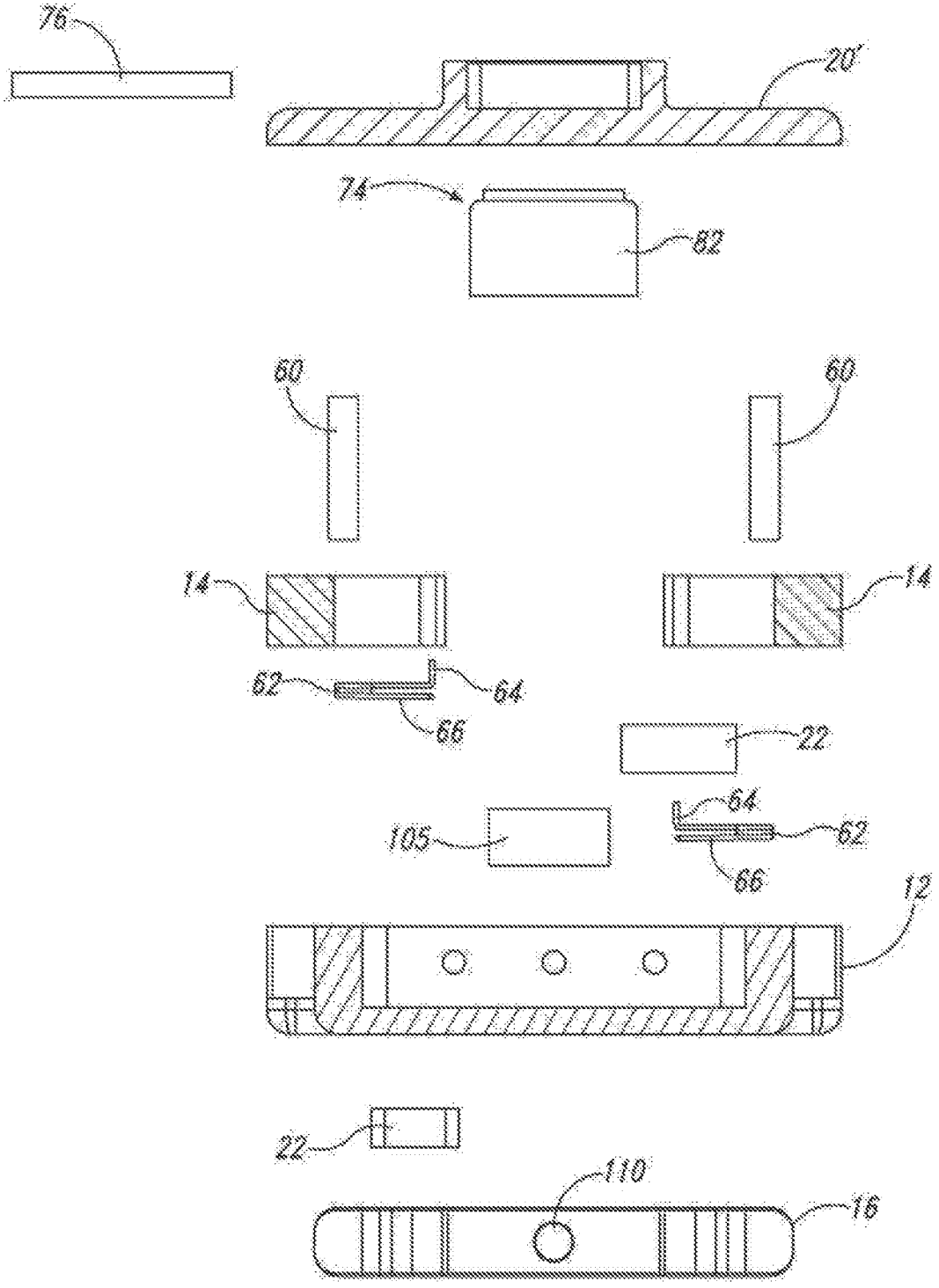
FIG. 22 is a bottom exploded view of the embodiment of FIG. 20.
Figure 23:
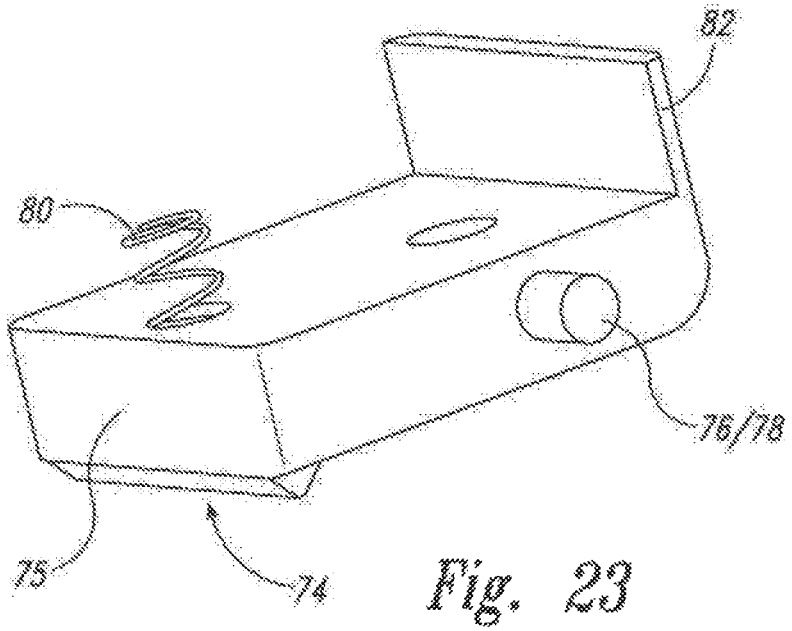
FIG. 23 is an enlarged bottom perspective view of the press button mechanism of FIG. 20.
Figure 24:
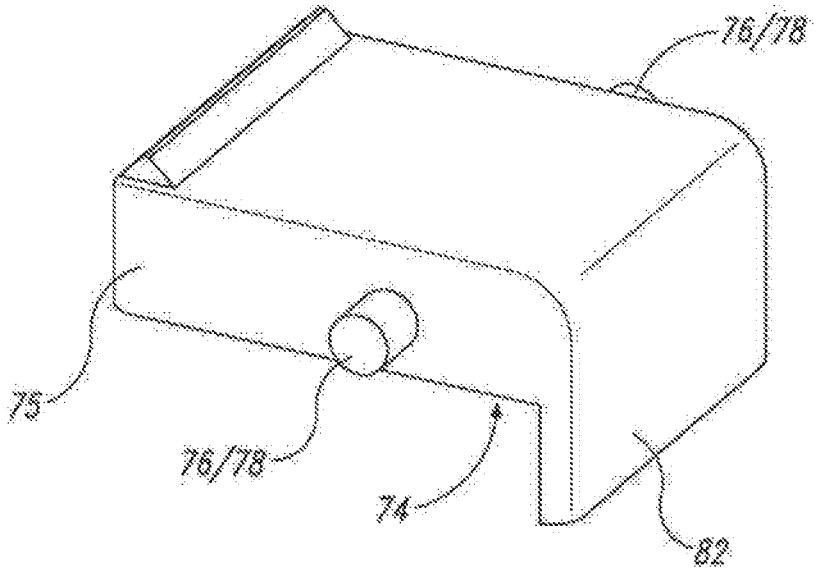
FIG. 24 is an enlarged top perspective view of the press button mechanism of FIG. 20.

During locking action, a lower lip 82 extends from mechanism housing 75 that engages with a slot or indent within the receiver base 84, such as on central abutment member 36, (FIG. 22). Lower lip 82 also is positioned directly above upper surface 59 of each locking tab lower arms. The physical relationship between the lower lip 82 and the locking tab lower arms, which may be touching but does not need to be, keeps the locking tabs from rotational movement until the button retracts the lower lip and the two locking tabs are rotated to disengage the insert projection from the cavity.

Torsion springs 62, as discussed above, may be embedded under each locking tab to keep inward tension of the locking tabs. The torsion springs mound around a respective cylindrical post (or pivot pin) to tension the spring with regard to its corresponding locking tab so that a user would need to squeeze them with approximately 5 lbs of pressure in order to release (pivot) the locking tabs.

When pressing the push button mechanism 74, it retracts the lower lip 82 and, therefore, disengages with the indent or slot 84 in receiver base 12 and no longer stops the lower arms of the locking tabs from rotation (and displacement of the leading edge of the insert). Then a user may squeeze on the two locking tabs at the same time as the push button is depressed to effectuate three point mechanical unlocking of the locking mechanism 10.

If used with the locking mechanism 100, the push button mechanism 74 along with the pivotable locking tabs act as a tertiary locking action to the two-stage locking verification means described to locking mechanism 100 (mechanical locking of the insert in the first stage; and electronic locking means of the second stage). In this embodiment, the push button must be depressed at the same time as depressing the locking tabs in order to pivot the locking tabs to disconnect (unlock) the insert from the locking tabs and receiver base cavity. The push button and two locking tabs form a three point contact before locking or unlocking can take place.

The locking mechanism 10, 100, 200 may be made of metal or main-made materials. In one form of the invention, locking mechanism 10, 100, 200 are made of aluminum. In another form they are made from carbon fiber as a strong, yet lightweight, alternative.

The invention includes both a control docking station system and a method of verifying when a locking mechanism may be safely released from a safety device as discussed above. Referring now to FIG. 25-34, a locking mechanism 300 having a female member 302 and a male member 304, similar to the locking mechanisms 10, 100, and 200 described above may be incorporated into a control docking system 400 that senses and controls when it is safe to change locking engagement between the female member and the male member and may be used to dock male member 304 when it is safe to do so during use and/or when the safety devices attached to the locking mechanisms are not in use.

The control docking system 400 may include the controller 124 as illustrated in FIG. 25 and described above or as controller 402 described in further detail below.

Figure 26:
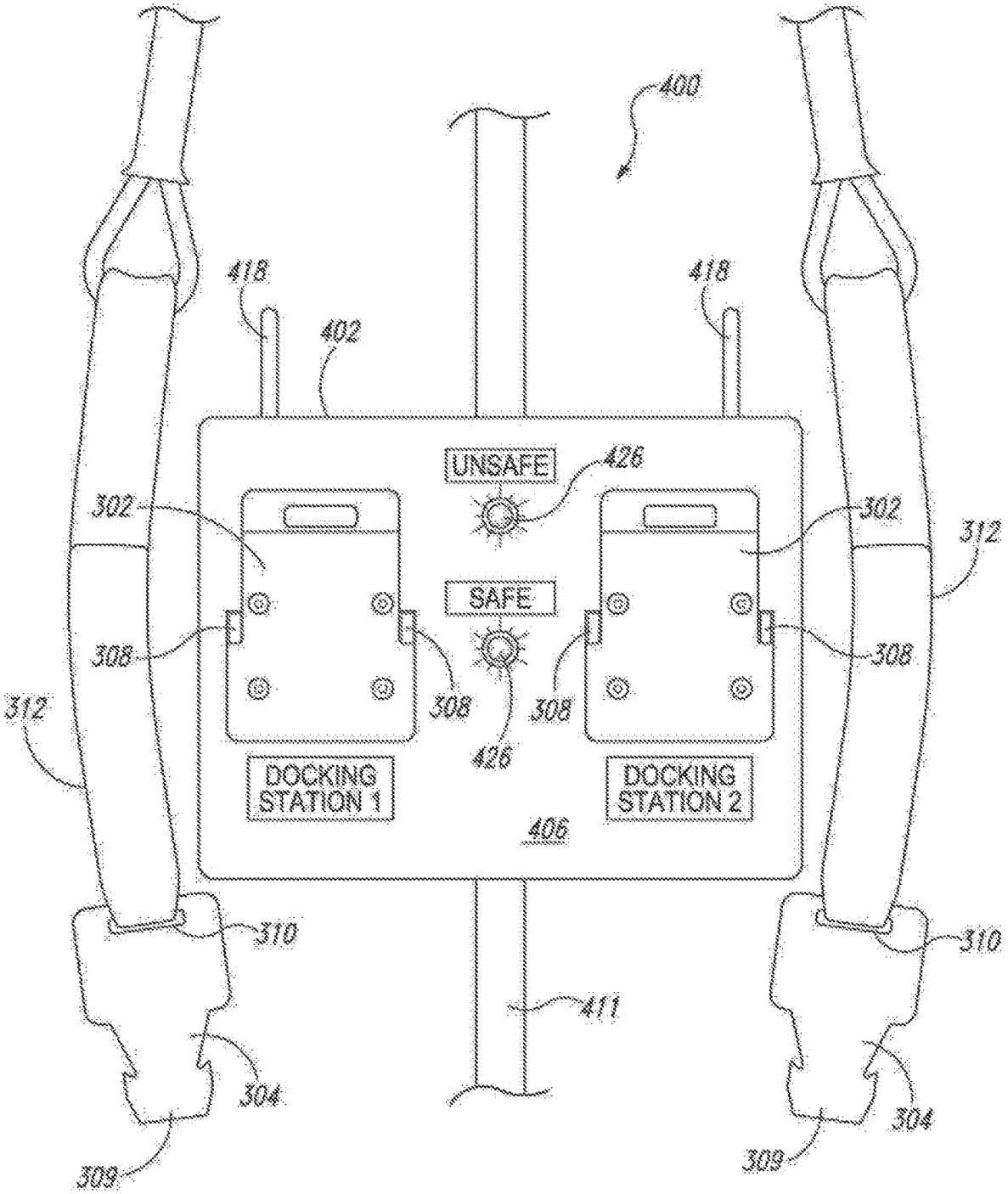
FIG. 26 is a perspective view of a control docking station having a controller and one or more locking blocks (female members of the locking mechanism), wherein each locking block is operably connected to an exterior surface of a controller container, and a male member from FIG. 25 that may be docked into the locking block on the controller container.
Figure 27:
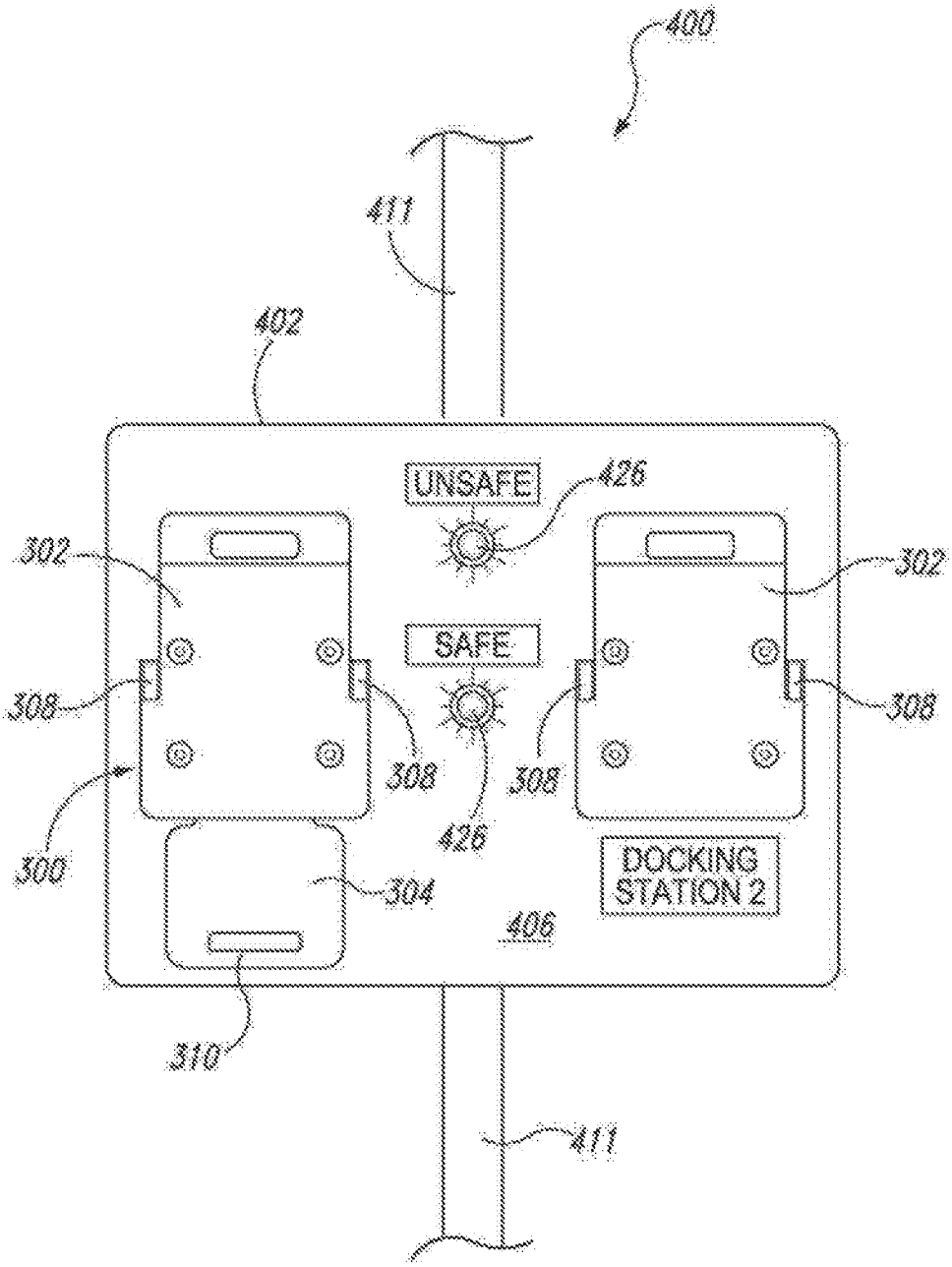
FIG. 27 is a front view of the control docking station of FIG. 26 illustrating two locking blocks with a male member, illustrated less its attached device, being docked within one of the two locking blocks.

In the embodiment of FIGS. 25-27, female member 302 includes a receiver base 306 and a pair of spaced apart locking tabs 308. Receiver base 306 has an upper portion akin to the lower section 26, as the female member 302 is illustrated in an inverted position relative to controller 402. Unlike receiver base 12, receiver base 306 does not need to include an opening, such as the opening illustrated at numeral 28 of FIG. 1, when the receiver base 306 (of the second female member) is operably connected to controller 402. Receiver base 306 also includes a lower portion, which includes an interior surface, akin to interior surface 24, and may include two spaced-apart and outwardly-projecting chocks (akin to chocks 22) that conform to the shape of an interior surface (similar to interior surface 24) of each locking tab 308. Receiver base 306, locking tabs 308, and optional chocks form a cavity that is akin to cavity 18.

Further, female member 302 may further include a central ledge, akin to central ledge 32, and an optional central abutment member, akin to central abutment member 36. Receiver base and optional chocks may be made from metal or heavy duty plastic (or other man-made material) and be a unitary piece of be made from separate components.

Each pair of locking tabs 308 has a first arm (akin to first arm 17 of locking tab 14) and a second arm (akin to second arm 19 of locking tab 14) connected by a central point, which is also the pivot point that rotates about a pivot pin (akin to cylindrical post 60), which is operatively connected to receiver base 306 in the same manner cylindrical post 60 is operably connected to receiver base 12. In this way, each locking tab 308 is rotatably connected to receiver base 306 about a pivot pin such that the first and second arms are positioned relative to the receiver base relative to a corresponding chock. The locking tabs and pivot pin may be made from metal or heavy duty plastic (or other man-made material), similar to the receiver base as discussed above.

Each locking tab 308 may include a top portion (akin to top portion 52), a side portion (akin to side portion 56), both part of the first arm, and a bottom portion (akin to bottom portion 34) of the second arm. The top portion may further include a "hook nose," similar to hook nose 54. The top portion, the side portion, and the bottom portion of each locking tab 308 may form an elongated "c-shaped cavity" (akin to c-shaped cavity 58) that may correspond to the shape of one of the optional chocks. The second arm of each locking tab 308 includes an upper surface (akin to surface 59) that may contact the male member as described further below. The second arm may further include a lower surface (akin to lower surface 61) that may abut the central ledge of receiver base 306.

Male member 304 includes an insert, which is akin to insert 16. Male member insert 309 is configured to be received within the cavity formed by receiver base 306, locking tabs 308, and optional chocks, and may abut the central ledge, such as illustrate in FIGS. 1, 2, 12, and 13. Male member insert 309 may be a solid planar slab having a lower portion that may include an external key-like projection (akin to key like projection 44) and has a leading edge (akin to leading edge 46). Between the key-like projection and an upper portion of the insert is a transition section (akin to transition section 48) that may form pockets (akin to pockets 49) on each side of the transition section. These pockets may be engaged by the hook nose top portions of locking tabs 308. Further, when male member insert 309 is inserted into female member 302, the male member insert's leading edge may make contact with the second arms of locking tabs 308.

Male member insert 309 is also includes an engagement member 310 that is operably engageable with a device 312, such as a safety device having webbing (akin to webbing 30) accessible through an opening, such as opening 50.

A torsion spring, akin to torsion spring 62, may be positioned between receiver base 306 and each locking tab 30 and in the same relationship as described between torsion spring 62 and locking mechanism 10 or locking mechanism 100 above.

A cover (akin to cover 20 or cover 20' when combined with a push button option akin to push button 74) may be used to cover receiver base 306, locking tabs 308, and optional chocks. Fastening means may include threaded and countersunk screws (akin to fasteners 21) to attach the cover to receiver base 306. Other well-know fastening means may be used.

Similar to locking mechanism 10, 100, or 200, (a first) female member 302 that is attached to the safety device, such as a safety harness attached to a self-retracting lifeline, may include an electronic bay (akin to electronic bay 102) that is incorporated into upper portion of receiver base 306. Female member 302 may also include the same electronic components; most positioned with the electronic bay, as that of locking mechanism 100. The electronic components send a signal to an external device (here, controller 402) and receive instructions as to when to magnetically release magnetically actuated switches positioned where contact is made between the female member at the second arm of locking tabs 308 and the male member insert's leading edge. These electronic components may include embedded reed switched (akin to reed switched 104), a circuit board (akin to circuit board 105), a relay (akin to relay 106), embedded shielded proximity switches, a pressure switch has mechanical engagement, an optical sensor, and optional indicator light (such as an LED light), and a battery or other power source (akin to battery 108). Additionally, there are magnetic actuators (akin to magnetic actuators 110), preferably three, to match corresponding reed switches (akin to reed switches 104). The magnetic actuators are positioned on each second arm of locking tabs 308 and on the leading edge of male member insert 309. When the insert makes contact with the female member locking tabs and optional central abutment, the switches/magnetic actuators are stage two locking. This electronic locking connection is in addition to the visual indication and "click sound" that takes place for stage one mechanical locking. Further, the act of magnetic locking engagement between the magnetic actuators and switches sends a signal to the controller regarding the status between the (first) female member attached to the safety device and the male member.

Figure 28:
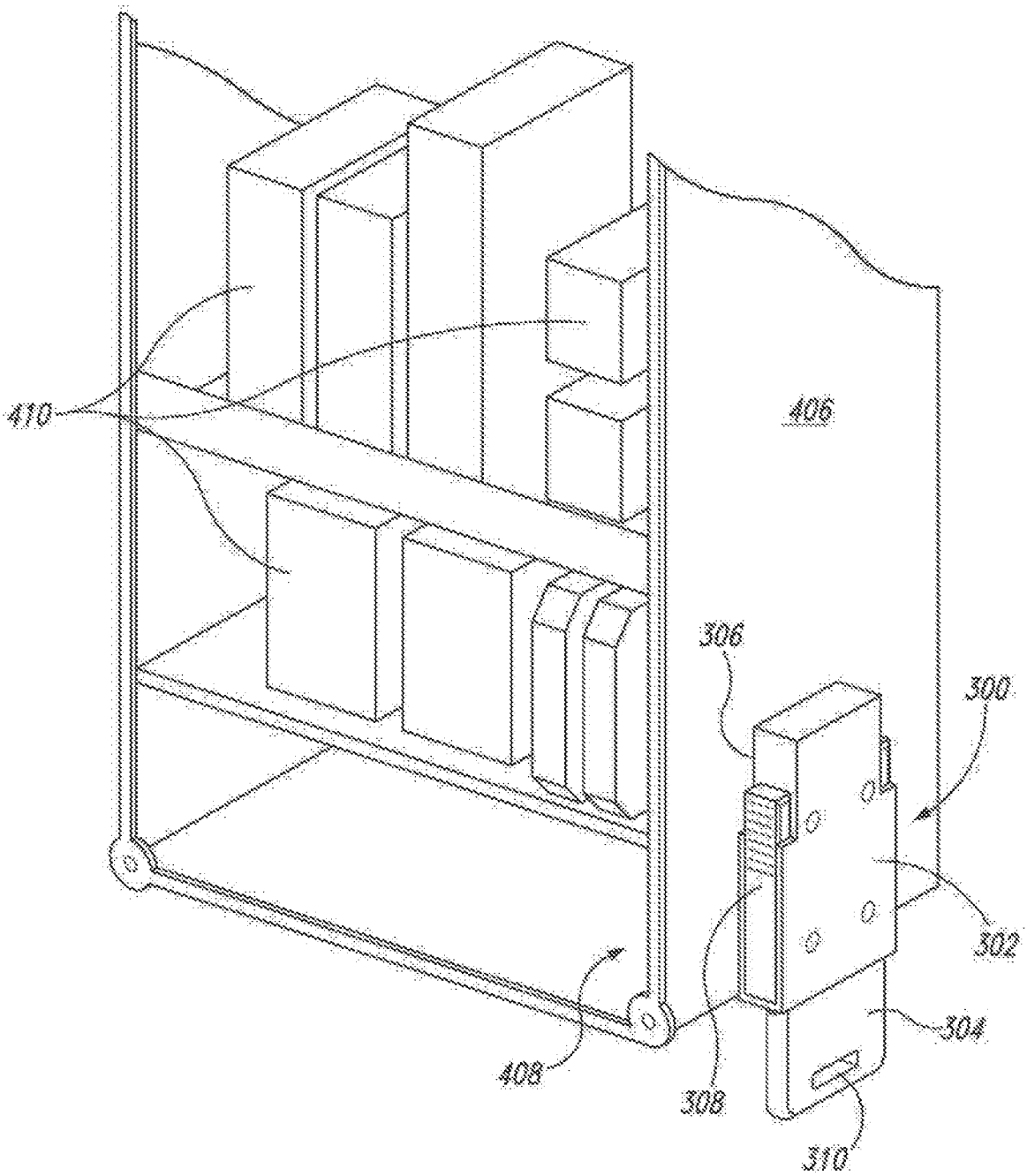
FIG. 28 is a perspective view of a locking block attached to a sidewall of the controller container.
Figure 29:
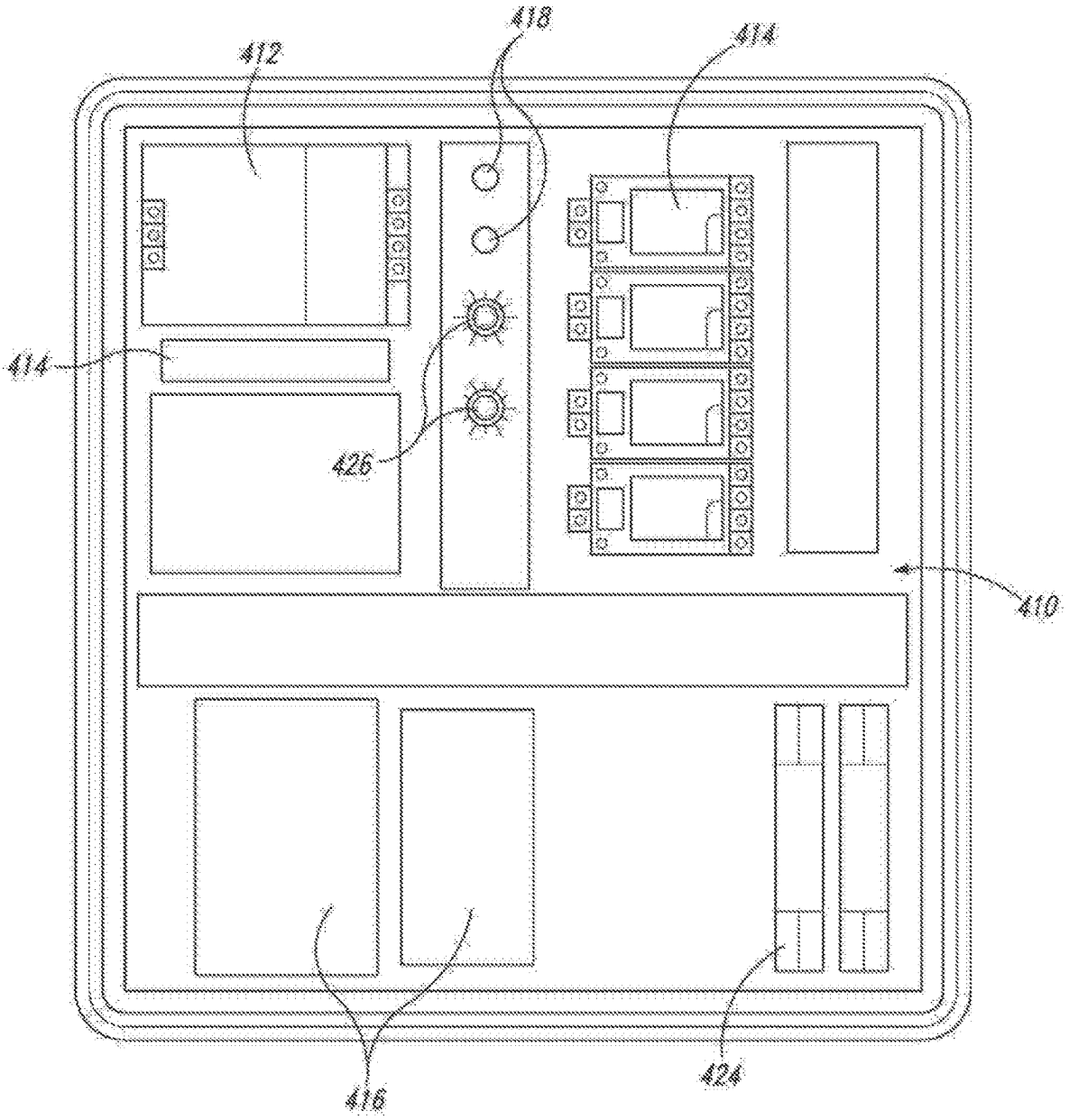
FIG. 29 is a schematic view of the electronic components within the controller.

Controller 402 includes a controller container 404 having an exterior surface 406 and an interior 408 that houses the majority of the controller electronic components 410. Controller container 404 may be mounted to a wall, as part of control equipment, or to a rail 411 as illustrated in FIG. 26. Referring particularly to FIGS. 26, 27, and 28, receiver base 306 of a second female member (also referred to as a locking block) 302 is operably connected to exterior surface 406 of controller container 404. There can be many variations on this placement. One or more receiver bases (corresponding to an equivalent number of second female members) may be positioned on a front of container 404, which is typically a box, such as illustrated in FIG. 26, or on the side of the container box, such as illustrated in FIG. 28, or at the top or bottom of the container box (not illustrated). One or more wireless antennas 418, typically one antenna corresponding per (second or subsequent) female member, may extend from the box as illustrated in FIG. 26.

Figure 31:
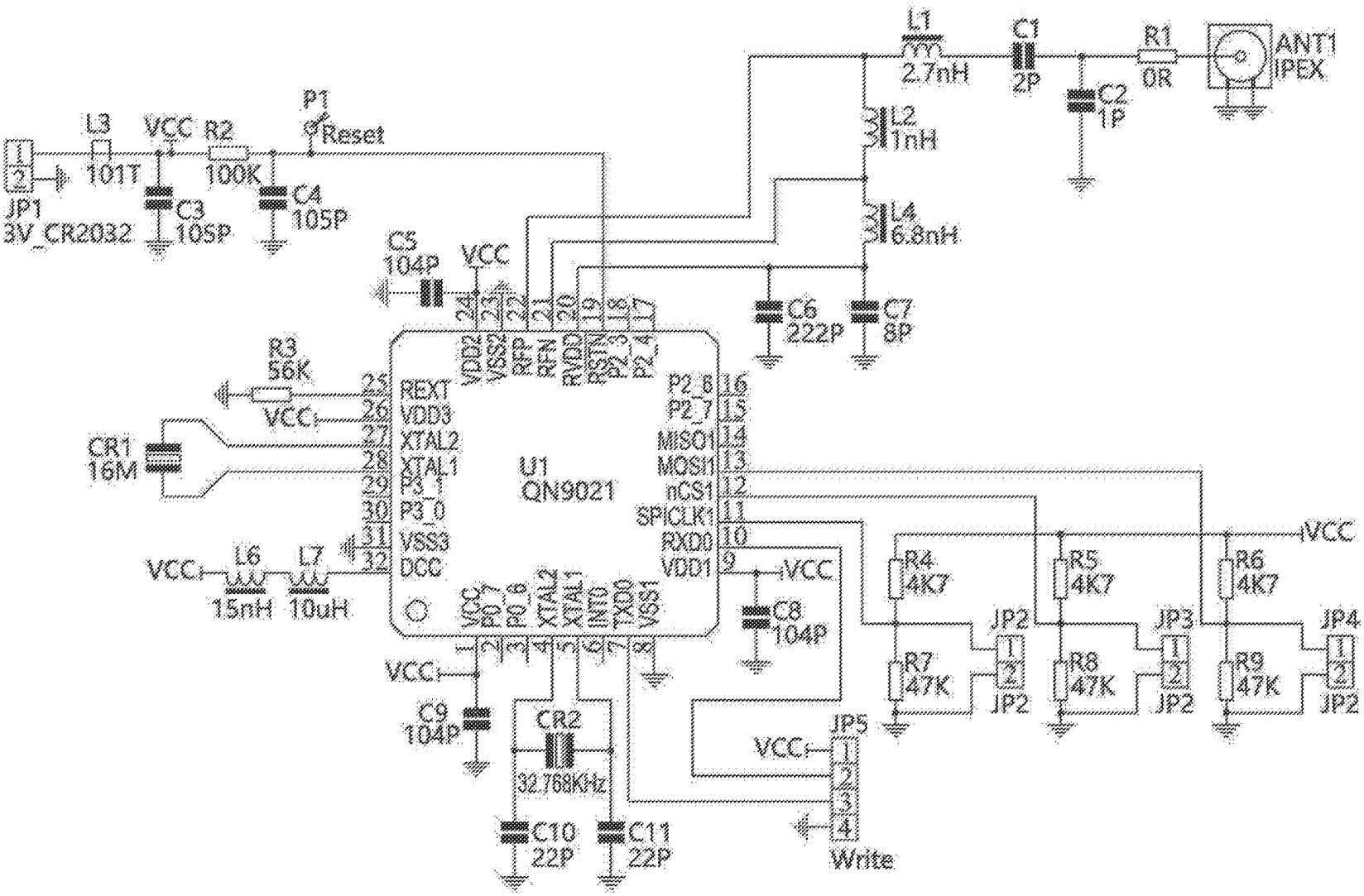
FIGS. 31 and 32 are exemplar circuit diagrams for circuit boards in the controller of FIGS. 26-30.
Figure 32:
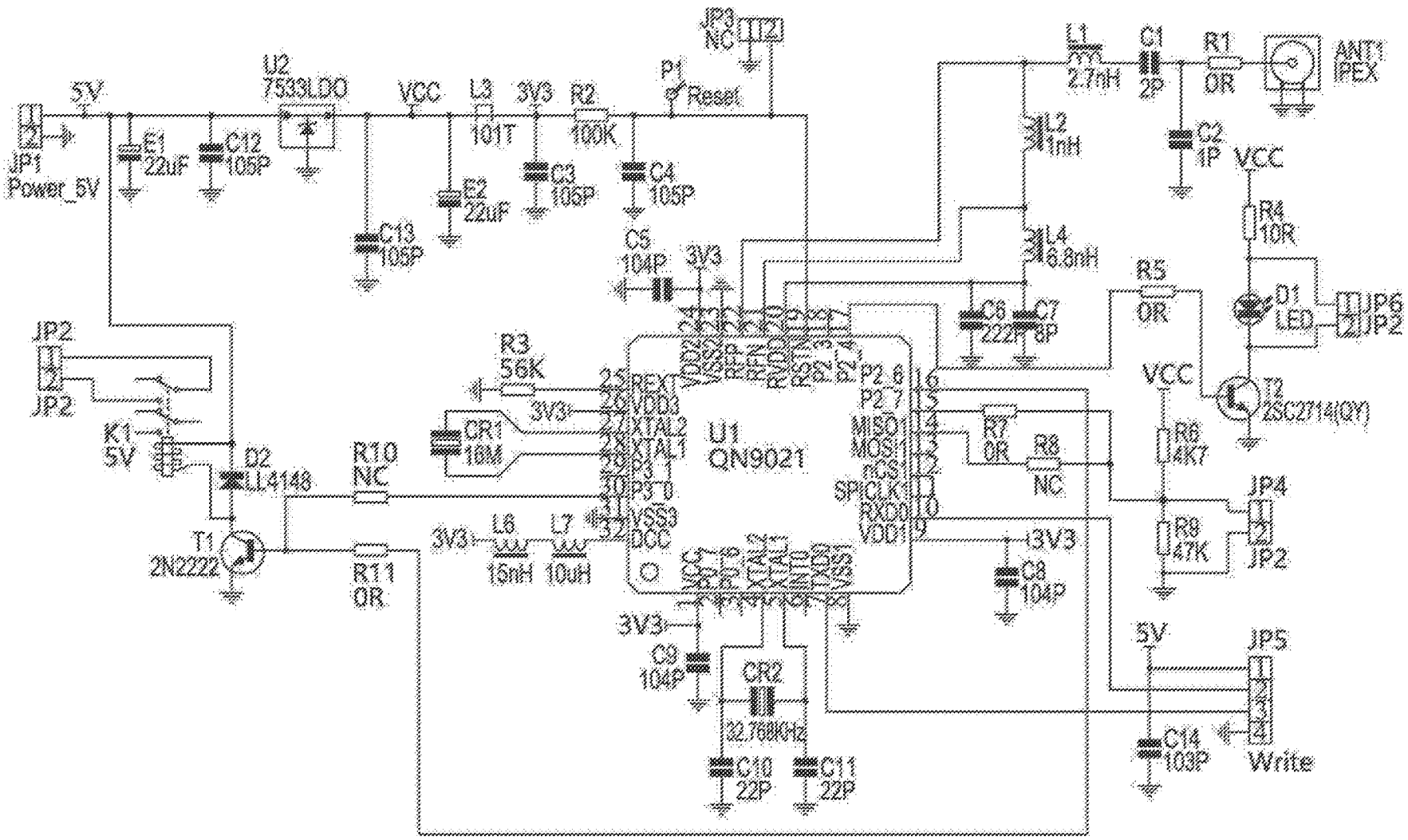
Figure 33:
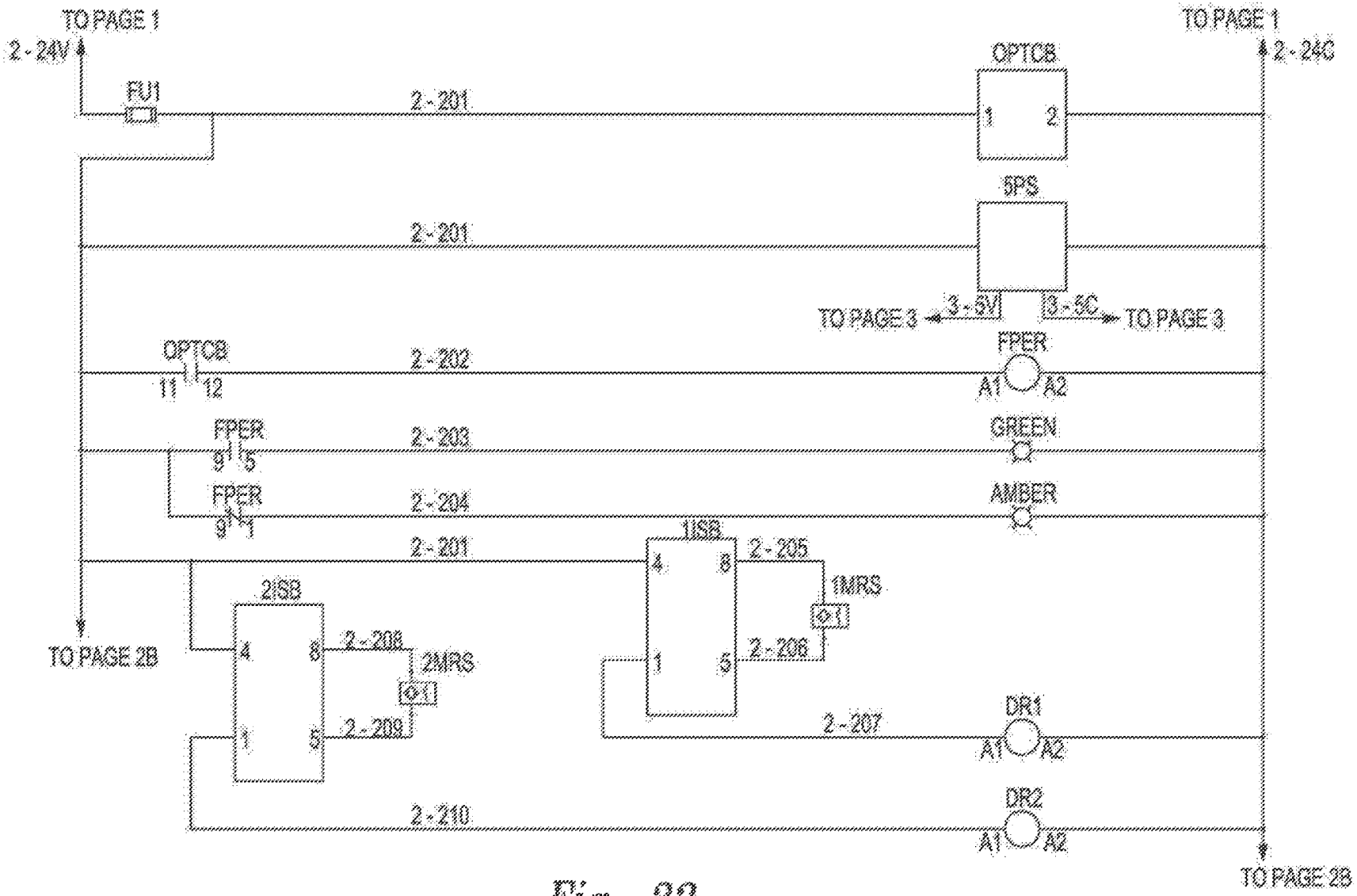
FIGS. 33 and 34 are exemplar control wiring diagrams for the controller of FIGS. 26-30.
Figure 34:
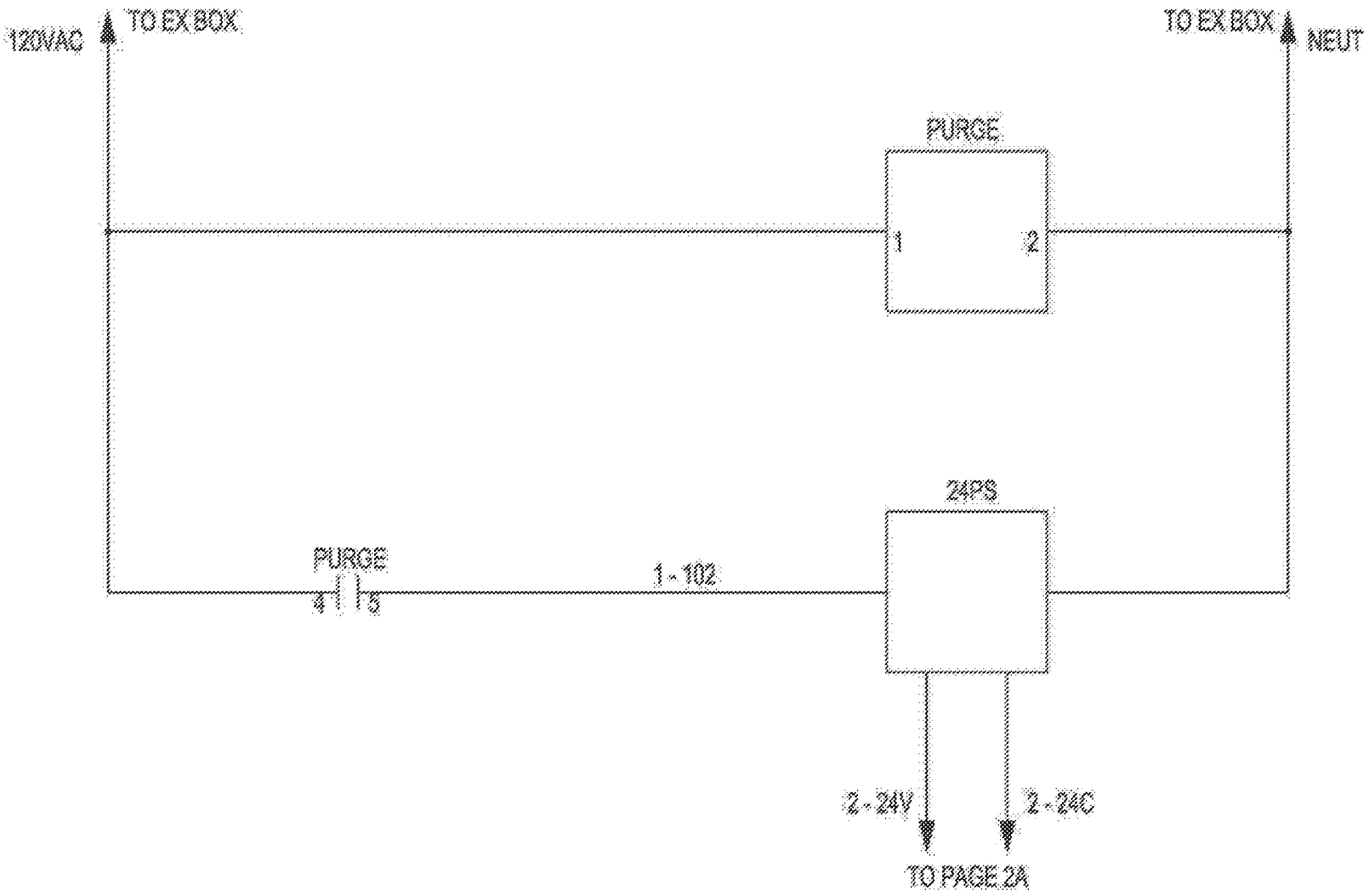

Referring particularly to FIGS. 29, and 31-34, controller electronic components 410 include a power source 412, relays 414, one or more circuit boards 416, a wireless transceiver (such as a BLUETOOTH wireless receiver), and antenna connector leads. FIGS. 31 and 32 represent examples of circuit diagrams for the circuit boards. These circuit diagrams indicate the addition of resistors, capacitors, inductors, diodes, LEDs, transistors, BLUETOOTH transceiver, and antenna connector leads. FIGS. 33 and 34 represent examples of control wiring diagrams (at 24 vdc).

A wireless antenna 418 may receive a signal from the (first) female member's wireless antenna 112 when stage two locking engagement takes place between the locking mechanism 100 or 200 (see FIG. 25), less insert 16, and male member 304 has take place. Wireless antenna 418 senses and sends to controller 402 an unsafe interlock signal that is determined by external sources, such as actual job site supervision or through a command center or computer program. If the unsafe interlock signal is interrupted, the magnetic locking engagement between (first) female member 302 and male member 304 can then be safely disconnected and the controller allows this disconnection by a signal to the (first) female member's wireless antenna 112 and a signal is sent to the switches on the male member insert 309 and locking tab 308 arms to disconnect the magnetic locking engagement.

The controller senses through continuous loop monitoring any interruption of the unsafe interlock signal. The interrupted unsafe interlock signal is effectively a safe signal which allows disconnection of locking engagement between the (first) female member an the male member. From there, the male member may be docked into the (second) female member operably connected to the docking station. The control docking system may also be used to secure the locking mechanisms when not in use, such that safety devices, particularly those that are attached to self-retracting lifelines, connected to the locking mechanisms can be accounted for and properly stored in downtime or off hours.

The second female member (the locking block or locking blocks) that is operably connected to the controller container may include a reed switch (akin to reed switch 104) that senses the magnetic actuator on the leading edge of male member insert 309 in order to detect safe docking when the male inserts/devices are being accounted for.

Multiple locking mechanisms (attached to corresponding workers) can be controlled by the controller at the same time. When an unsafe interlock signal is interrupted for a locking mechanism, the male member of that locking mechanism is allowed to detach from the (first) female member attached to the safety device. That male member may then be safely docked within a (second, third, fourth, or more) female member operably connected to the controlled container. The system can be configured to monitor and control multiple locking engagement between multiple male members and (first) female members in active safety situations and that individual workers can disconnect their locking mechanisms from their corresponding safety devices at various times relative to each other. In this regard, docking a male member from a first worker into a (second) female member on the controller container can be accomplished apart from other workers where their locking mechanisms are still connected to corresponding safety devices and the locking engagement is still monitored and controlled by the controller.

Figure 30:
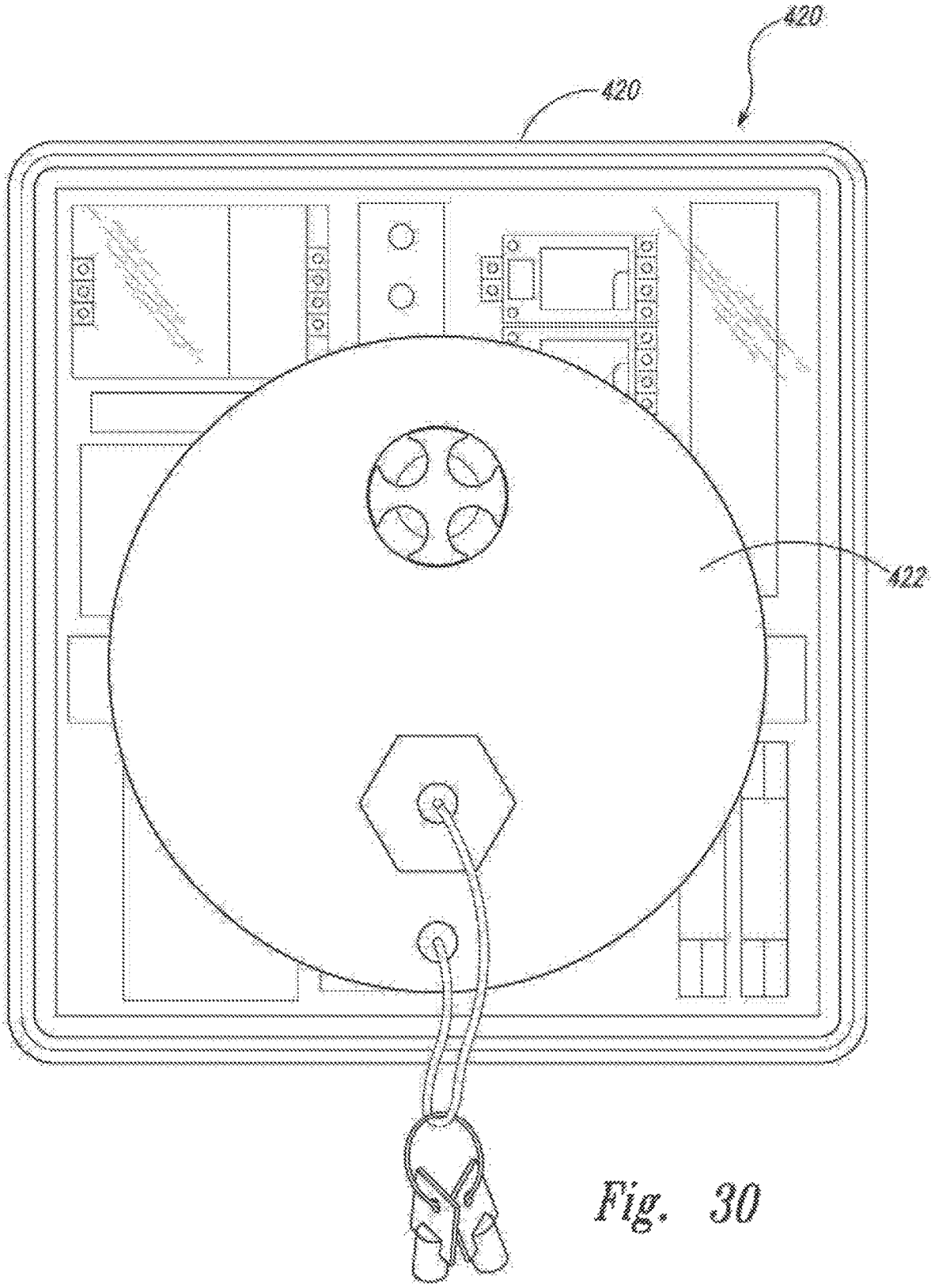
FIG. 30 is a front view of an alternate embodiment controller with a purge control and controller container configured to be explosion proof.

The controller can be adapted from class I explosion-proof applications/environments by using an explosion-proof container 420 as illustrated in FIG. 30, along with a purge controller 422 and relay 424 that keeps the door shut until the relay is activated.

Visual indication of an "unsafe" or "safe" condition may be part of the control docking system. According to one form of the invention, indicator lights 426 may be added to controller box (404, 420) and the light emitting source and protective cover may extend from the exterior surface of the controller container, typically near the female member(s) which is positioned on the exterior surface of the controller container.

The controller may itself be controlled by a computer 126 as illustrated in FIG. 25 or an off-sight safety command center.

It is to be understood that many changes in the particular structure, materials, and features of the invention may be made without departing from the spirit and scope of the invention. Therefore it is the Applicant's intention that its patent rights not the limited by the particular embodiments illustrated and described herein, but rather by the following claims interpreted according to accepted doctrines of claim interpretation, including the Doctrine of Equivalents, and Reversal of Parts.

The invention claimed is:

1. A locking system, comprising:

a receiver base having a cavity;

a first locking tab disposed inside the cavity configured to pivot about a first pin operatively coupled to the receiver base;

a second locking tab disposed inside the cavity configured to pivot about a second pin operatively coupled to the receiver base;

an insert device having a leading edge configured to be received within the cavity and to be engaged by the first locking tab and the second locking tab to keep the insert retained within the cavity;

a first electronic switch disposed in the cavity and configured to actuate when the first locking tab pivots when contacted by the insert device;

a second electronic switch disposed in the cavity and configured to actuate when the second locking tab pivots when contacted by the insert device; and a third electronic switch disposed in the cavity and configured to actuate when adjacent to the leading edge.

2. The locking system of claim 1, wherein:

a first magnetic actuator disposed on the insert device in a position to be adjacent to the first locking tab when inserted into the cavity;

a second magnetic actuator disposed on the insert device in a position to be adjacent to the second locking tab when inserted into the cavity; and a third magnetic actuator disposed on the leading edge of the insert device.

3. The locking system of to claim 1, further comprising a push button assembly having a retractable lip configured to engage with an indentation within the receiver base to block rotational movement of the first arm and the second arm.

4. The locking system of to claim 1, wherein the insert device further comprises a solid planar slab having a lower portion that includes an external key like projection that forms the leading edge.

5. The locking system of to claim 4, wherein the insert device further comprises a transition section disposed adjacent to the leading edge and having a first pocket configured to interface with the first arm and a second pocket configured to interface with the second arm.

6. The locking system of to claim 1, further comprising:

a first torsion spring disposed adjacent to the first locking tab and configured to bias the first locking tab to a position to receive the insert device; and a second torsion spring disposed adjacent to the second locking tab and configured to bias the second locking tab to a position to receive the insert device.

7. The locking system of to claim 1, further comprising a safety harness having a webbing attached to the receiver base.

8. The locking system of to claim 1, further comprising a safety harness having a webbing attached to the insert device.

9. The locking system of to claim 1, wherein the electronic switches comprises one or more of the group composed of: a reed switch, a proximity switch, a circuit board, a relay, an optical sensor, and a pressure switch.

10. The locking system of to claim 1, wherein the electronic switches form a circuit that, when completed, enables a signal to a remote indicator that indicates that each switch has been actuated.

11. The locking system of to claim 10, further comprising a controller communicatively coupled to the receiver base and configured to receive the signal and to engage functionality of a remote system in response to receiving the signal.

12. The locking system of to claim 11, wherein the controller is further configured to cease functionality of the remote system in response to interruption of the signal because one or more electronic switches is interrupted.

13. The locking system of to claim 11, wherein the controller is further configured to receive the signal wirelessly.

14. A safety system, comprising:

an industrial system having a lockout function that ceases functionality of the industrial system when locked out; and a lockout system communicatively coupled to the industrial system, comprising:

a receiver base having a cavity;

a first locking tab disposed inside the cavity configured to pivot about a first pin operatively coupled to the receiver base;

a second locking tab disposed inside the cavity configured to pivot about a second pin operatively coupled to the receiver base;

an insert device having a leading edge configured to be received within the cavity and to be engaged by the first locking tab and the second locking tab to keep the insert retained within the cavity;

a first electronic switch disposed in the cavity and configured to actuate when the first locking tab pivots when contacted by the insert device;

a second electronic switch disposed in the cavity and configured to actuate when the second locking tab pivots when contacted by the insert device; and a third electronic switch disposed in the cavity and configured to actuate when adjacent to the leading edge;

wherein, the lockout function of the industrial system is engaged if one or more of the electronic switches is unactuated.

15. The safety system of claim 14, wherein the electronic switches form a circuit that, when completed, enables a signal to a remote indicator that indicates that each switch has been actuated.

16. The safety system of claim 14, further comprising a controller communicatively coupled to the receiver base and configured to receive the signal and to engage functionality of the industrial system in response to receiving the signal.

17. The safety system of claim 16, wherein the controller is further configured to cease functionality of the industrial system in response to interruption of the signal because one or more electronic switches is interrupted.

18. The safety system of to claim 16, wherein the controller is further configured to receive the signal wirelessly.

19. The safety system of claim 14, further comprising a controller configured to control functionality of an additional industrial system in response to the electronic switches of the lockout system.

20. The safety system of claim 14, an alarm that is actuated in response to an interruption on functionality.

* * * * *